US011328688B2

(12) United States Patent
Chu et al.

(10) Patent No.: US 11,328,688 B2
(45) Date of Patent: May 10, 2022

(54) PIXEL COMPENSATION METHOD AND DEVICE, STORAGE MEDIUM, AND DISPLAY SCREEN

(71) Applicant: BOE Technology Group Co., Ltd., Beijing (CN)

(72) Inventors: Mingi Chu, Beijing (CN); Yicheng Lin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 52 days.

(21) Appl. No.: 16/959,172

(22) PCT Filed: Dec. 23, 2019

(86) PCT No.: PCT/CN2019/127488
§ 371 (c)(1),
(2) Date: Jun. 30, 2020

(87) PCT Pub. No.: WO2020/140787
PCT Pub. Date: Jul. 9, 2020

(65) Prior Publication Data

US 2021/0225325 A1 Jul. 22, 2021

(30) Foreign Application Priority Data

Jan. 3, 2019 (CN) ..... 201910005170.1

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2320/0271* (2013.01);
(Continued)

(58) Field of Classification Search
CPC ..... G09G 5/10; G09G 3/3225; G09G 2320/0271; G09G 2320/045; G09G 2360/141; G09G 2360/145
See application file for complete search history.

(56) References Cited

U.S. PATENT DOCUMENTS

2013/0135272 A1* 5/2013 Park ..... G09G 3/3233 345/211
2014/0240375 A1* 8/2014 Ha ..... G09G 3/006 345/690

(Continued)

FOREIGN PATENT DOCUMENTS

CN 105225640 A 1/2016
CN 106887212 A 6/2017

(Continued)

OTHER PUBLICATIONS

International search report of PCT application No. PCT/CN2019/127488 dated Mar. 13, 2020.

(Continued)

*Primary Examiner* — Antonio Xavier
(74) *Attorney, Agent, or Firm* — Fay Sharpe LLP

(57) ABSTRACT

The present disclosure relates to a pixel compensation method and device, a storage medium, and a display screen, and belongs to the field of display technologies. The method includes: sensing a plurality of subpixels in a first target grayscale of a display screen by using a plurality of photosensitive units, to obtain an actual luminance value of each subpixel; determining a theoretical luminance value of each subpixel in the first target grayscale based on a compensation sensing model, where the compensation sensing model is used to record a correspondence between target grayscales and theoretical pixel data, and the theoretical pixel data includes a reference luminance value of each subpixel; and performing pixel compensation on each subpixel based on (Continued)

the actual luminance value of each subpixel and the theoretical luminance value of each subpixel.

18 Claims, 11 Drawing Sheets

(52) U.S. Cl.
CPC . *G09G 2320/045* (2013.01); *G09G 2360/141* (2013.01); *G09G 2360/145* (2013.01)

(56) References Cited

U.S. PATENT DOCUMENTS

| | | | | |
|---|---|---|---|---|
| 2015/0116384 | A1 | 4/2015 | Kim et al. | |
| 2017/0193920 | A1* | 7/2017 | Kim | G01J 1/30 |
| 2017/0243562 | A1* | 8/2017 | Hu | G09G 5/10 |
| 2018/0150935 | A1* | 5/2018 | Tang | G06T 5/002 |
| 2018/0357954 | A1* | 12/2018 | Lynch | G09G 3/3208 |
| 2019/0057657 | A1 | 2/2019 | Liu et al. | |
| 2019/0287453 | A1 | 9/2019 | Weng | |
| 2020/0152116 | A1* | 5/2020 | Chen | G09G 3/2092 |
| 2020/0160791 | A1* | 5/2020 | Chung | G09G 3/3275 |
| 2020/0168139 | A1* | 5/2020 | Lee | G09G 3/3611 |
| 2020/0410918 | A1* | 12/2020 | Gai | G09G 3/2003 |
| 2021/0020097 | A1* | 1/2021 | Taguchi | G09G 3/32 |

FOREIGN PATENT DOCUMENTS

| | | | |
|---|---|---|---|
| CN | 106935196 | A | 7/2017 |
| CN | 107610649 | A | 1/2018 |
| CN | 108428721 | A | 8/2018 |
| CN | 109523955 | A | 3/2019 |
| KR | 20150048967 | A | 5/2015 |

OTHER PUBLICATIONS

First office action of Chinese application No. 201910005170.1 dated Dec. 18, 2019.

* cited by examiner

PIXEL COMPENSATION METHOD AND DEVICE, STORAGE MEDIUM, AND DISPLAY SCREEN

This application is a 371 of PCT Patent Application Serial No. PCT/CN2019/127488, filed on Dec. 23, 2019, which claims priority to Chinese Patent Application No. 201910005170.1, filed on Jan. 3, 2019, and entitled "PIXEL COMPENSATION METHOD AND DEVICE, STORAGE MEDIUM, AND DISPLAY SCREEN", the entire contents of which are incorporated herein by reference.

TECHNICAL FIELD

The present disclosure relates to the field of display technologies, and in particular, to a pixel compensation method and device, a storage medium, and a display screen.

BACKGROUND

With development of display technologies, organic light emitting diode (OLED) display screens are increasingly applied to high-performance display products because of their characteristics: self-illumination, fast responses, wide viewing angles, and the like. To ensure quality of the OLED display screens, pixel compensation needs to be performed on the OLED display screens to improve uniformity of images displayed by the display screens.

SUMMARY

Embodiments of the present disclosure provide a pixel compensation method and device, a storage medium, and a display screen.

In a first aspect, a pixel compensation method is provided. The method is applied to a display screen, wherein the display screen comprises a plurality of subpixels and a plurality of photosensitive units in a one-to-one correspondence with the plurality of subpixels, each photosensitive unit is used to sense a corresponding subpixel, and the method comprises:

sensing the plurality of subpixels in a first target grayscale of the display screen by using the plurality of photosensitive units, to obtain an actual luminance value of each subpixel;

determining a theoretical luminance value of each subpixel in the first target grayscale based on a compensation sensing model, wherein the compensation sensing model is used to record a correspondence between target grayscales and theoretical pixel data, the theoretical pixel data comprises a reference luminance value of each subpixel, and the theoretical luminance value of each subpixel is in a one-to-one correspondence with the reference luminance value of each subpixel; and performing pixel compensation on each subpixel based on the actual luminance value of each subpixel and the theoretical luminance value of each subpixel.

Optionally, the performing pixel compensation on each subpixel based on the actual luminance value of each subpixel and the theoretical luminance value of each subpixel comprises:

determining a compensation error of each subpixel based on the actual luminance value of each subpixel and the theoretical luminance value of each subpixel;

determining whether the compensation error of each subpixel falls within a preset error range; and if the compensation error of each subpixel falls outside the preset error range, adjusting luminance of each subpixel to perform pixel compensation on each subpixel.

Optionally, the determining a compensation error of each subpixel based on the actual luminance value of each subpixel and the theoretical luminance value of each subpixel comprises:

determining the compensation error according to a compensation error formula, wherein the compensation error formula is as follows:

$$\Delta E = k \times x' - x, \text{ wherein}$$

ΔE denotes the compensation error, x' denotes the actual luminance value, x denotes the theoretical luminance value, k is a compensation factor, and k is a constant greater than 0.

Optionally, the compensation sensing model is used to record a one-to-one correspondence between target grayscales, theoretical pixel data, and theoretical sensing data, the theoretical sensing data comprises a theoretical sensing parameter value of each photosensitive unit, and the theoretical sensing parameter value of each photosensitive unit is a sensing parameter value when each photosensitive unit senses the corresponding subpixel and obtains a corresponding theoretical luminance value;

before the sensing the plurality of subpixels in a first target grayscale of the display screen by using the plurality of photosensitive units, to obtain an actual luminance value of each subpixel, the method further comprises:

determining theoretical sensing data corresponding to the first target grayscale from the compensation sensing model; and adjusting the sensing parameter value of each photosensitive unit based on the theoretical sensing data corresponding to the first target grayscale, so that the sensing parameter value of each photosensitive unit is the theoretical sensing parameter value; and the sensing the plurality of subpixels in a first target grayscale of the display screen by using the plurality of photosensitive units, to obtain an actual luminance value of each subpixel comprises:

sensing the plurality of subpixels in the first target grayscale based on corresponding theoretical sensing parameter values by using the plurality of photosensitive units, to obtain the actual luminance value of each subpixel.

Optionally, the display screen has m target grayscales, the first target grayscale is any one of the m target grayscales, m is an integer greater than or equal to 1, and the reference luminance value is the theoretical luminance value; and before the determining theoretical sensing data corresponding to the first target grayscale from the compensation sensing model, the method further comprises:

sensing the plurality of subpixels in each of the m target grayscales by using the plurality of photosensitive units, to obtain a theoretical luminance value of each subpixel in each target grayscale;

determining theoretical luminance values of the plurality of subpixels in each target grayscale as theoretical pixel data corresponding to each target grayscale;

determining theoretical sensing data corresponding to each target grayscale; and generating the compensation sensing model based on theoretical pixel data corresponding to the m target grayscales and theoretical sensing data corresponding to the m target grayscales.

Optionally, the display screen has m target grayscales, the first target grayscale is any one of the m target grayscales, m is an integer greater than or equal to 1, the reference luminance value is a difference between the theoretical luminance value and an initial luminance value, and the initial luminance value of each subpixel is a luminance value obtained through sensing by a corresponding photosensitive unit when the display screen displays a black image; and before the determining theoretical sensing data corresponding to the first target grayscale from the compensation sensing model, the method further comprises:

sensing the plurality of subpixels in each of the m target grayscales by using the plurality of photosensitive units, to obtain a theoretical luminance value of each subpixel in each target grayscale;

determining a difference between the theoretical luminance value of each subpixel and an initial luminance value of each subpixel in each target grayscale, to obtain a reference luminance value of each subpixel in each target grayscale;

determining reference luminance values of the plurality of subpixels in each target grayscale as theoretical pixel data corresponding to each target grayscale;

determining theoretical sensing data corresponding to each target grayscale; and generating the compensation sensing model based on theoretical pixel data corresponding to the m target grayscales and theoretical sensing data corresponding to the m target grayscales.

Optionally, the sensing the plurality of subpixels in each of the m target grayscales by using the plurality of photosensitive units, to obtain a theoretical luminance value of each subpixel in each target grayscale comprises:

sensing the plurality of subpixels in each of the m target grayscales by using the plurality of photosensitive units, to obtain a luminance value of each subpixel in each target grayscale;

determining whether the luminance value of each subpixel falls within a preset luminance value range; and if the luminance value of each subpixel falls within the preset luminance value range, determining the luminance value of each subpixel as a theoretical luminance value of each subpixel in each target grayscale; or if the luminance value of each subpixel falls outside the preset luminance value range, adjusting a sensing parameter value of a photosensitive unit corresponding to each subpixel, so that a luminance value obtained when each photosensitive unit senses the corresponding subpixel based on an adjusted sensing parameter value falls within the preset luminance value range; and determining, as a theoretical luminance value of the subpixel in each target grayscale, a luminance value obtained when each photosensitive unit senses the corresponding subpixel based on an adjusted sensing parameter value.

Optionally, the sensing parameter value of the photosensitive unit comprises an illumination time and an integration capacitance, and the adjusting a sensing parameter value of a photosensitive unit corresponding to each subpixel comprises: adjusting at least one of the illumination time and the integration capacitance of the photosensitive unit corresponding to each subpixel based on a priority of the illumination time and a priority of the integration capacitance, wherein the priority of the illumination time is higher than the priority of the integration capacitance.

Optionally, before the determining whether the luminance value of each subpixel falls within a preset luminance value range, the method further comprises:

when the display screen displays a black image, sensing the plurality of subpixels by using the plurality of photosensitive units, to obtain the initial luminance value of each subpixel;

determining a luminance correction value of each subpixel based on the initial luminance value of each subpixel;

correcting the luminance value of each subpixel in each target grayscale based on the luminance correction value of each subpixel; and the determining whether the luminance value of each subpixel falls within a preset luminance value range comprises: determining whether a corrected luminance value of each subpixel falls within the preset luminance value range.

Optionally, the reference luminance value is the theoretical luminance value, and after the adjusting luminance of each subpixel, the method further comprises:

determining an actual luminance value of each subpixel whose luminance is adjusted; and updating the reference luminance value of each subpixel in the compensation sensing model using the actual luminance value of each subpixel.

Optionally, the reference luminance value is the difference between the theoretical luminance value and the initial luminance value, and after the adjusting luminance of each subpixel, the method further comprises:

when the display screen displays a black image, sensing the plurality of subpixels by using the plurality of photosensitive units, to obtain the initial luminance value of each subpixel;

determining an actual luminance value of each subpixel whose luminance is adjusted;

determining a difference between the actual luminance value of each subpixel and the initial luminance value of each subpixel; and updating the reference luminance value of each subpixel in the compensation sensing model using the difference between the actual luminance value of each subpixel and the initial luminance value of each subpixel.

In a second aspect, a pixel compensation device is provided. The device is applied to a display screen, wherein the display screen comprises a plurality of subpixels and a plurality of photosensitive units in a one-to-one correspondence with the plurality of subpixels, each photosensitive unit is used to sense a corresponding subpixel, and the device comprises:

a sensing subcircuit, used to sense the plurality of subpixels in a first target grayscale of the display screen by using the plurality of photosensitive units, to obtain an actual luminance value of each subpixel;

a first determining subcircuit, used to determine a theoretical luminance value of each subpixel in the first target grayscale based on a compensation sensing model, wherein the compensation sensing model is used to record a correspondence between target grayscales and theoretical pixel data, the theoretical pixel data comprises a reference luminance value of each subpixel, and the theoretical luminance value of each subpixel is in a one-to-one correspondence with the reference luminance value of each subpixel; and a compensation subcircuit, used to perform pixel compensation on each subpixel based on the actual luminance value of each subpixel and the theoretical luminance value of each subpixel.

Optionally, the compensation subcircuit is used to:

determine a compensation error of each subpixel based on the actual luminance value of each subpixel and the theoretical luminance value of each subpixel;

determine whether the compensation error of each subpixel falls within a preset error range; and if the compensation error of each subpixel falls outside the preset error range, adjust luminance of each subpixel to perform pixel compensation on each subpixel.

Optionally, the compensation subcircuit is used to:

determine the compensation error according to a compensation error formula, wherein the compensation error formula is as follows:

$$\Delta E = k \times x' - x, \text{ wherein}$$

ΔE denotes the compensation error, x' denotes the actual luminance value, x denotes the theoretical luminance value, k is a compensation factor, and k is a constant greater than 0.

Optionally, the compensation sensing model is used to record a one-to-one correspondence between target grayscales, theoretical pixel data, and theoretical sensing data, the theoretical sensing data comprises a theoretical sensing parameter value of each photosensitive unit, the theoretical sensing parameter value of each photosensitive unit is a sensing parameter value when each photosensitive unit senses the corresponding subpixel and obtains a corresponding theoretical luminance value, and the device further comprises:

a second determining subcircuit, used to determine theoretical sensing data corresponding to the first target grayscale from the compensation sensing model before the plurality of subpixels are sensed in the first target grayscale of the display screen by using the plurality of photosensitive units to obtain the actual luminance value of each subpixel; and an adjustment subcircuit, used to adjust the sensing parameter value of each photosensitive unit based on the theoretical sensing data corresponding to the first target grayscale, so that the sensing parameter value of each photosensitive unit is the theoretical sensing parameter value, wherein the sensing subcircuit is used to sense the plurality of subpixels in the first target grayscale based on corresponding theoretical sensing parameter values by using the plurality of photosensitive units, to obtain the actual luminance value of each subpixel.

Optionally, the display screen has m target grayscales, the first target grayscale is any one of the m target grayscales, m is an integer greater than or equal to 1, the reference luminance value is the theoretical luminance value, and the device further comprises:

a generation subcircuit, used to:

before the theoretical sensing data corresponding to the first target grayscale is determined from the compensation sensing model, sense the plurality of subpixels in each of the m target grayscales by using the plurality of photosensitive units, to obtain a theoretical luminance value of each subpixel in each target grayscale;

determine theoretical luminance values of the plurality of subpixels in each target grayscale as theoretical pixel data corresponding to each target grayscale;

determine theoretical sensing data corresponding to each target grayscale; and generate the compensation sensing model based on theoretical pixel data corresponding to the m target grayscales and theoretical sensing data corresponding to the m target grayscales.

Optionally, the display screen has m target grayscales, the first target grayscale is any one of the m target grayscales, m is an integer greater than or equal to 1, the reference luminance value is a difference between the theoretical luminance value and an initial luminance value, the initial luminance value of each subpixel is a luminance value obtained through sensing by a corresponding photosensitive unit when the display screen displays a black image, and the device further comprises:

a generation subcircuit, used to:

before the theoretical sensing data corresponding to the first target grayscale is determined from the compensation sensing model, sense the plurality of subpixels in each of the m target grayscales by using the plurality of photosensitive units, to obtain a theoretical luminance value of each subpixel in each target grayscale;

determine a difference between the theoretical luminance value of each subpixel and an initial luminance value of each subpixel in each target grayscale, to obtain a reference luminance value of each subpixel in each target grayscale;

determine reference luminance values of the plurality of subpixels in each target grayscale as theoretical pixel data corresponding to each target grayscale;

determine theoretical sensing data corresponding to each target grayscale; and generate the compensation sensing model based on theoretical pixel data corresponding to the m target grayscales and theoretical sensing data corresponding to the m target grayscales.

Optionally, the generation subcircuit is used to:

sense the plurality of subpixels in each of the m target grayscales by using the plurality of photosensitive units, to obtain a luminance value of each subpixel in each target grayscale;

determine whether the luminance value of each subpixel falls within a preset luminance value range; and if the luminance value of each subpixel falls within the preset luminance value range, determine the luminance value of each subpixel as a theoretical luminance value of each subpixel in each target grayscale; or if the luminance value of each subpixel falls outside the preset luminance value range, adjust a sensing parameter value of a photosensitive unit corresponding to each subpixel, so that a luminance value obtained when each photosensitive unit senses the corresponding subpixel based on an adjusted sensing parameter value falls within the preset luminance value range; and determine, as a theoretical luminance value of the subpixel in each target grayscale, a luminance value obtained when each photosensitive unit senses the corresponding subpixel based on an adjusted sensing parameter value.

Optionally, the sensing parameter value of the photosensitive unit comprises an illumination time and an integration capacitance, and the generation subcircuit is used to: adjust at least one of the illumination time and the integration capacitance of the photosensitive unit corresponding to each subpixel based on a priority of the illumination time and a priority of the integration capacitance, wherein the priority of the illumination time is higher than the priority of the integration capacitance.

Optionally, the device further includes:

a correction subcircuit, used to:

before whether the luminance value of each subpixel falls within the preset luminance value range is determined, and when the display screen displays a black image, sense the plurality of subpixels by using the plurality of photosensitive units, to obtain the initial luminance value of each subpixel;

determine a luminance correction value of each subpixel based on the initial luminance value of each subpixel; and correct the luminance value of each subpixel in each target grayscale based on the luminance correction value of each subpixel, wherein the first generation subcircuit or the second generation subcircuit is used to determine whether a corrected luminance value of each subpixel falls within the preset luminance value range.

Optionally, the reference luminance value is the theoretical luminance value, and the device further comprises:

a first update subcircuit, used to:

after the luminance of each subpixel is adjusted, determine an actual luminance value of each subpixel whose luminance is adjusted; and update the reference luminance value of each subpixel in the compensation sensing model using the actual luminance value of each subpixel.

Optionally, the reference luminance value is the difference between the theoretical luminance value and the initial luminance value, and the device further comprises:

a second update subcircuit, used to:

after the luminance of each subpixel is adjusted, and when the display screen displays a black image, sense the plurality of subpixels by using the plurality of photosensitive units, to obtain the initial luminance value of each subpixel;

determine an actual luminance value of each subpixel whose luminance is adjusted;

determine a difference between the actual luminance value of each subpixel and the initial luminance value of each subpixel; and update the reference luminance value of each subpixel in the compensation sensing model using the difference between the actual luminance value of each subpixel and the initial luminance value of each subpixel.

In a third aspect, a storage medium is provided. The storage medium stores an instruction, and when the instruction is run on a processing assembly, the processing assembly is enabled to perform the pixel compensation method according to the first aspect or any one of the alternatives of the first aspect.

In a fourth aspect, a pixel compensation device is provided. The device includes:

a processor; and a memory used to store an executable instruction of the processor, wherein the processor is used to execute the instruction stored in the memory, to perform the pixel compensation method according to the first aspect or any one of the alternatives of the first aspect.

In a fifth aspect, a display screen is provided. The display screen includes: a plurality of subpixels, a plurality of photosensitive units in a one-to-one correspondence with the plurality of subpixels, and the pixel compensation device according to the second aspect or any one of the alternatives of the second aspect; or, includes: a plurality of subpixels, a plurality of photosensitive units in a one-to-one correspondence with the plurality of subpixels, and the pixel compensation device according to the fourth aspect or any one of the alternatives of the fourth aspect;

and each photosensitive unit is used to sense a corresponding subpixel.

BRIEF DESCRIPTION OF THE DRAWINGS

In order to describe the technical solutions in the embodiments of the present more clearly, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

The accompanying drawings, which are incorporated in and constitute a part of this specification, illustrate embodiments consistent with the present disclosure, and together with the description, serve to explain the principles of the present disclosure.

DETAILED DESCRIPTION

For clearer descriptions of the objects, technical solutions and advantages in the embodiments of the present disclosure, the present disclosure is described in detail below in combination with the accompanying drawings. Apparently, the described embodiments are merely some embodiments, rather than all embodiments, of the present disclosure. Based on the embodiments of the present disclosure, all other embodiments derived by a person of ordinary skill in the art without creative efforts shall fall within the protection scope of the present disclosure.

A pixel compensation method in a related technology is usually an optical compensation method whose compensation procedure is as follows. Before an OLED display screen is delivered, the OLED display screen is lighted up in each of a plurality of feature grayscales. A photograph of the OLED display screen is shot by using a charge-coupled device (CCD) after the OLED display screen is lighted up in each feature grayscale, to obtain a feature image of the OLED display screen. The feature image is analyzed to obtain a luminance value of each subpixel of the OLED display screen in a corresponding feature grayscale. The luminance value of each subpixel in a corresponding feature grayscale is used as a compensation luminance value of each subpixel in the feature grayscale. The OLED display screen is modeled based on compensation luminance values of each subpixel in the plurality of feature grayscales, to obtain a characteristic curve of the grayscales and compensation luminance. When pixel compensation is performed on the OLED display screen, the OLED display screen is lighted up in a grayscale, and an ideal luminance value corresponding to the grayscale is determined based on a correspondence between a grayscale and ideal luminance. Then an actual grayscale corresponding to a compensation luminance value equal to the ideal luminance value is determined based on the characteristic curve of the grayscales and compensation luminance, and the actual grayscale of each subpixel is used to compensate for luminance of the corresponding subpixel in the grayscale.

However, an organic light-emitting layer in the OLED display screen gradually ages with increasing use of time, and uniformity of an image displayed by the aging OLED display screen decreases. The pixel compensation method can be used to perform pixel compensation only before the OLED display screen is delivered, and therefore, cannot be used to compensate aging pixels of the OLED display screen. Consequently, the image displayed by the OLED display screen has relatively low uniformity.

Figure 1:
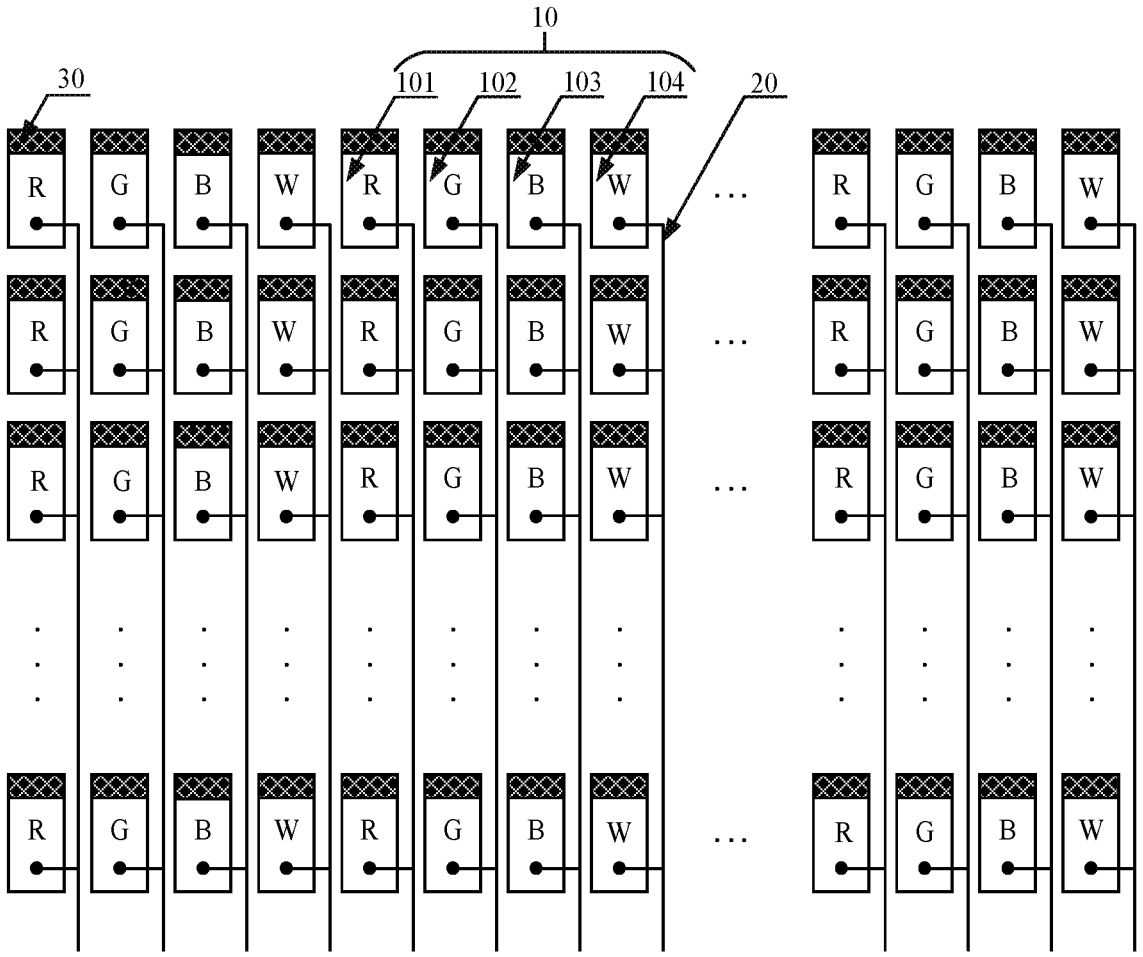
FIG. 1 is a front view of a display screen according to an embodiment of the present disclosure.

FIG. 1 is a front view of a display screen according to an embodiment of the present disclosure. The display screen may be an OLED display screen or a quantum dot light emitting diode (QLED) display screen. The display screen includes a plurality of pixels 10 arranged in an array, each pixel 10 includes a plurality of subpixels, and the subpixels of the display screen are arranged in arrays to form a plurality of pixel columns. The display screen further includes a plurality of photosensitive units in a one-to-one correspondence with the plurality of subpixels, a plurality of data lines 20 connected to the plurality of pixel columns in a one-to-one correspondence, and a control circuit (not shown in FIG. 1) connected to the plurality of photosensitive units. The control circuit may be a control integrated circuit (IC). Each photosensitive unit may include a photosensitive element 30 and a processing element (not shown in FIG. 1). The photosensitive element 30 is disposed around a corresponding subpixel and is spaced from the corresponding subpixel at a distance less than a preset distance. Each photosensitive unit is used to sense a corresponding subpixel to obtain a luminance value of the corresponding subpixel. Each data line 20 is connected to each subpixel in the plurality of corresponding pixel columns. For example, as shown in FIG. 1, each pixel 10 includes a red subpixel 101, a green subpixel 102, a blue subpixel 103, and a white subpixel 104. Each photosensitive element 30 is disposed around a corresponding subpixel. For example, a photosensitive element 30 corresponding to the red subpixel 101 is disposed on the red subpixel 101 shown in FIG. 1. It should be noted that a location relationship between the subpixel and the photosensitive element 30 shown in FIG. 1 is merely exemplary. In practical applications, the photosensitive element 30 may be disposed at any location around a corresponding subpixel, provided that the photosensitive unit being capable of accurately sensing the corresponding subpixel is ensured.

Figure 2:
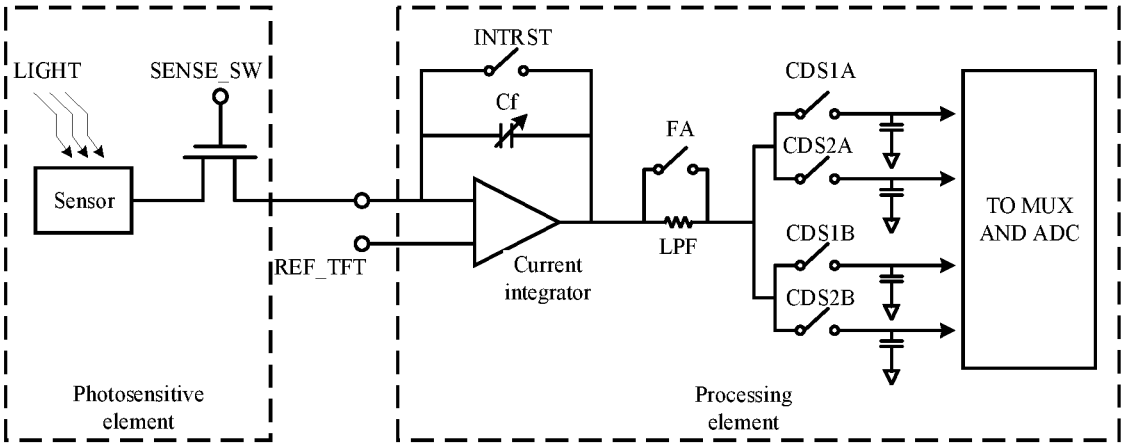
FIG. 2 is a diagram of a sensing circuit of a display screen according to an embodiment of the present disclosure.

FIG. 2 is a diagram of a sensing circuit of the display screen shown in FIG. 1. The photosensitive unit includes the photosensitive element and the processing element. The photosensitive element includes a sensor and a sensor switch (SENSE_SW) connected to the sensor. The processing element includes a current integrator, a low pass filter (LPF), an integrator capacitor (Cf), a correlated double sampling (CDS) 1A, a CDS 2A, a CDS 1B, a CDS 2B, a first switch INTRST, a second switch FA, and a multiplexer (MUX) and an analog-to-digital converter (ADC) that are integrally disposed. A first input end of the current integrator is connected to the sensor by using the SENSE_SW. A second input end of the current integrator is connected to a thin film transistor (TFT) of a subpixel. An output end of the current integrator is connected to one end of the LPF. The other end of the LPF is separately connected to a first end of the CDS 1A, a first end of the CDS 2A, a first end of the CDS 1B, and a first end of the CDS 2B. A second end of the CDS 1A, a second end of the CDS 2A, a second end of the CDS 1B, and a second end of the CDS 2B are separately connected to the MUX and the ADC that are integrally disposed. Two ends of the Cf are respectively connected to the first input end and the output end of the current integrator, the first switch INTRST is connected to the two ends of the Cf, and the second switch FA is connected to the two ends of the LPF. The SENSE_SW is used to control the sensor to sense light emitted by a subpixel, to obtain a current signal, and transmit the current signal obtained through sensing to the current integrator. Then the current integrator, the LPF, the CDS, the MUX, and the ADC sequentially process the current signal to obtain a luminance value of the subpixel. It should be noted that description is provided by using an example in which the plurality of subpixels are in a one-to-one correspondence with the plurality of photosensitive units and each photosensitive unit includes the photosensitive element and the processing element in FIG. 1 and FIG. 2. In practical applications, each photosensitive unit may include only the photosensitive element. A plurality of photosensitive elements may be connected to a same processing unit by using the MUX. A structure of the processing unit may be the same as a structure of the processing element shown in FIG. 2. The MUX may select current signals that are output by the plurality of photosensitive elements, so that the current signals that are output by the plurality of photosensitive elements are input to the processing unit in a time sharing manner. The processing unit processes the current signal transmitted by each photosensitive element, to obtain a luminance value of a corresponding subpixel.

Figure 3:
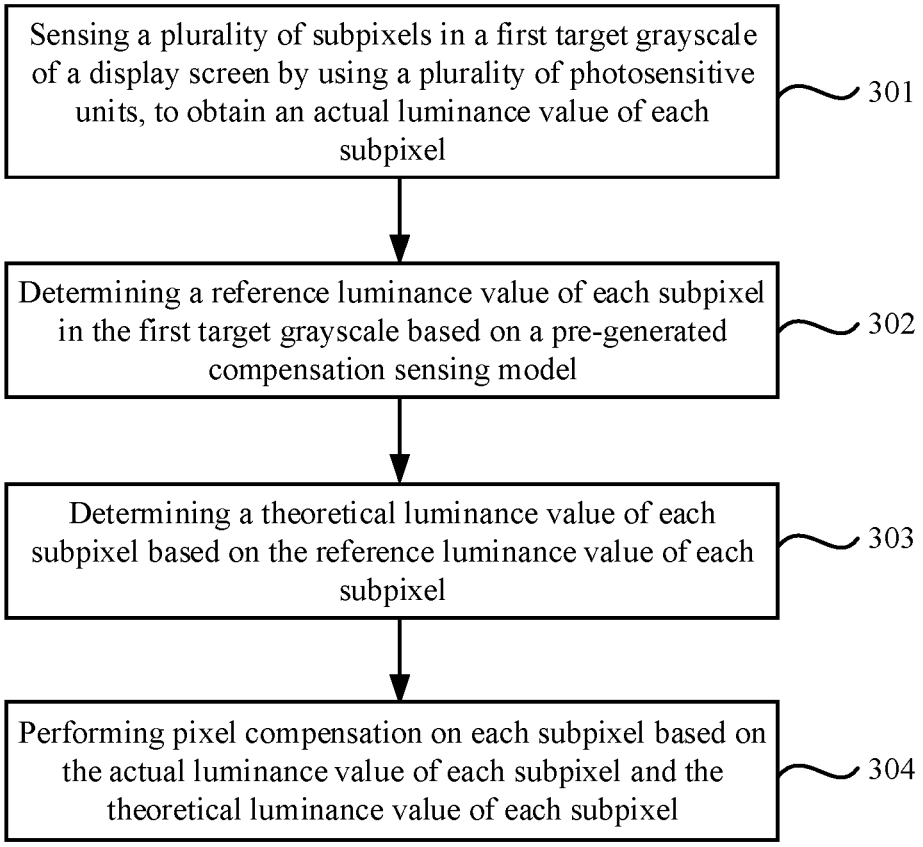
FIG. 3 is a method flowchart of a pixel compensation method according to an embodiment of the present disclosure.

An embodiment of the present disclosure provides a pixel compensation method. The method may be applied to the display screen shown in FIG. 1. The pixel compensation method may be performed by the control IC of the display screen, and the control IC may be a timing controller (TCON). Referring to FIG. 3, the pixel compensation method may include the following steps.

Step 301. Sense a plurality of subpixels in a first target grayscale of the display screen by using a plurality of photosensitive units, to obtain an actual luminance value of each subpixel.

Step 302. Determine a reference luminance value of each subpixel in the first target grayscale based on a compensation sensing model.

The compensation sensing model is used to record a correspondence between target grayscales and theoretical pixel data, and the theoretical pixel data includes the reference luminance value of each subpixel.

Step 303. Determine a theoretical luminance value of each subpixel based on the reference luminance value of each subpixel.

In this embodiment of the present disclosure, the theoretical luminance value of each subpixel is in a one-to-one correspondence with the reference luminance value of each subpixel.

Step 304. Perform pixel compensation on each subpixel based on the actual luminance value of each subpixel and the theoretical luminance value of each subpixel.

The theoretical luminance value of each subpixel in the first target grayscale may be determined based on the compensation sensing model according to steps 302 and 303. In a possible implementation, the theoretical luminance value needs to be calculated based on the reference luminance value. In this case, step 303 needs to be performed to obtain the theoretical luminance value. It should be noted that, in another possible implementation, the theoretical luminance value is the reference luminance value. In this case, step 303 may be omitted.

To sum up, in the pixel compensation method provided in this embodiment of the present disclosure, the display screen may sense the subpixel by using the photosensitive unit, to obtain the actual luminance value of the subpixel, determine the theoretical luminance value of the subpixel based on the compensation sensing model, and then perform pixel compensation on the subpixel based on the theoretical luminance value and the actual luminance value of the subpixel, thereby implementing pixel compensation during use of the display screen. In this way, compensation may be performed for an aging display screen, and uniformity of an image displayed by the display screen is enhanced.

Figure 4:
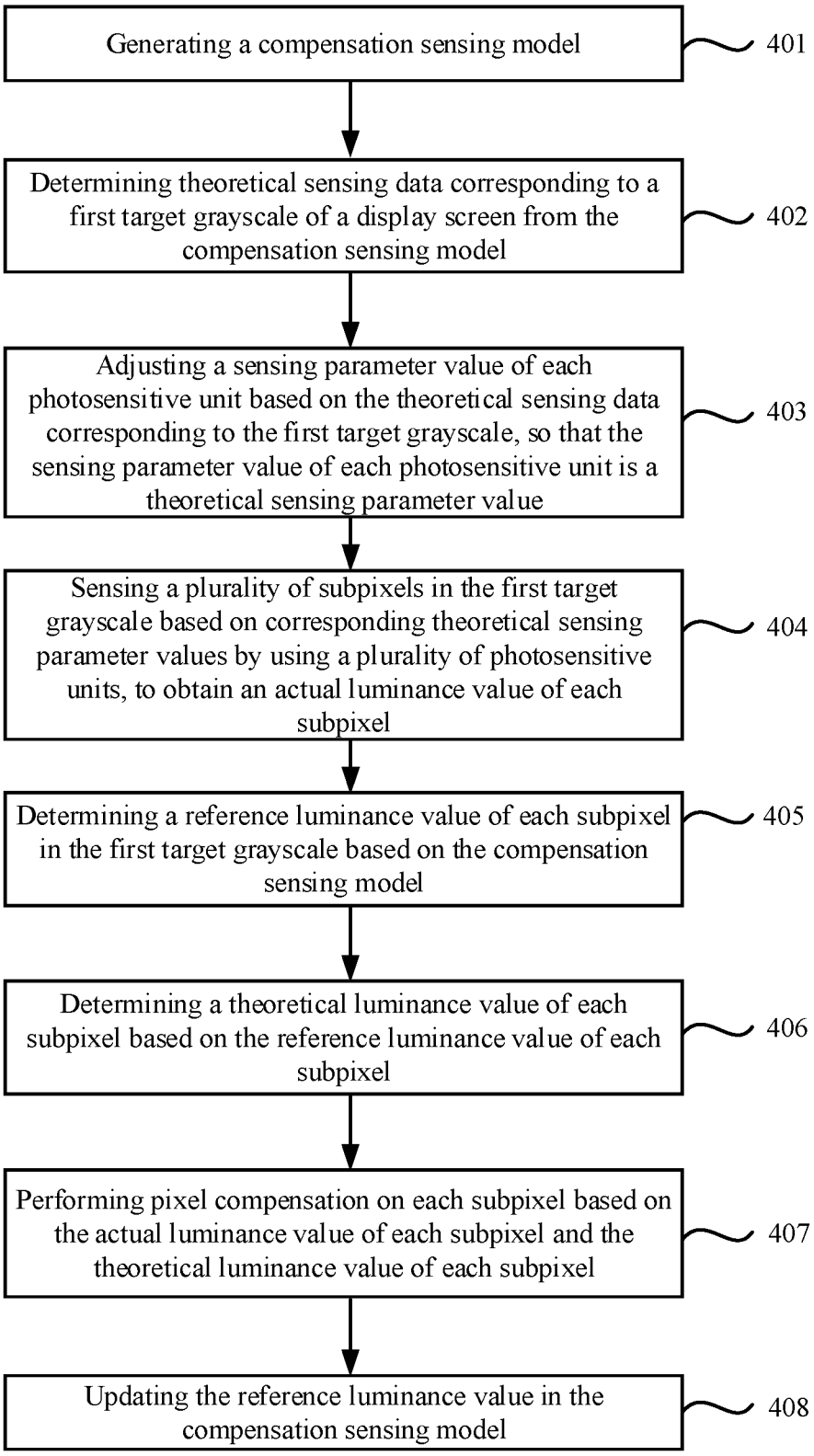
FIG. 4 is a method flowchart of another pixel compensation method according to an embodiment of the present disclosure.

FIG. 4 is a method flowchart of another pixel compensation method according to an embodiment of the present disclosure. The pixel compensation method may be performed by a control IC of a display screen, and the control IC may be a TCON. The pixel compensation method may include the following steps.

Step 401. Generate a compensation sensing model.

The compensation sensing model is used to record a correspondence between target grayscales and theoretical pixel data. Further, the compensation sensing model is used to record a one-to-one correspondence between target grayscales, theoretical pixel data, and theoretical sensing data. In this embodiment of the present disclosure, the display screen has m target grayscales, and m is an integer greater than or equal to 1. The m target grayscales are m target grayscales selected from a plurality of grayscales of the display screen. For example, the display screen has 256 grayscales: L0 to L255. Them target grayscales may be m target grayscales selected from the 256 grayscales, and may be a grayscale L1, a grayscale L3, a grayscale L5, and the like. As shown in FIG. 1, the display screen includes the plurality of subpixels and the plurality of photosensitive units in a one-to-one correspondence with the plurality of subpixels. Each photosensitive unit is used to sense a corresponding subpixel. The theoretical pixel data includes a reference luminance value of each subpixel, the theoretical sensing data includes a theoretical sensing parameter value of each photosensitive unit, and the theoretical sensing parameter value of each photosensitive unit is a sensing parameter value when each photosensitive unit senses the corresponding subpixel.

The reference luminance value may be a theoretical luminance value or a difference between the theoretical luminance value and an initial luminance value. The initial luminance value of each subpixel is a luminance value obtained through sensing by a corresponding photosensitive unit when the display screen displays a black image. In other words, the theoretical luminance value of each subpixel is in a one-to-one correspondence with the reference luminance value of each subpixel. In this embodiment of the present disclosure, step 401 may include either of the following two implementations based on different reference luminance values.

Figure 5:
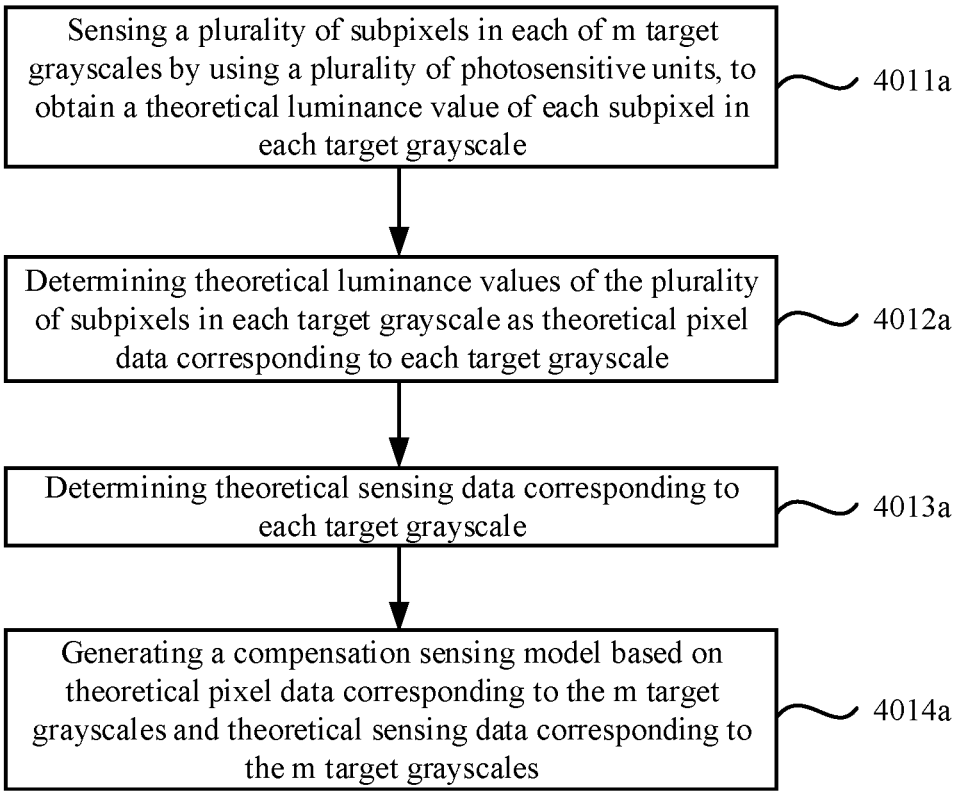
FIG. 5 is a flowchart of a method for generating a compensation sensing model according to an embodiment of the present disclosure.

In a first implementation of step 401, the reference luminance value is the theoretical luminance value. In this way, FIG. 5 is a flowchart of a method for generating a compensation sensing model according to an embodiment of the present disclosure. The method may include the following step.

Substep 4011*a*. Sense the plurality of subpixels in each of them target grayscales by using the plurality of photosensitive units, to obtain a theoretical luminance value of each subpixel in each target grayscale.

Figure 6:
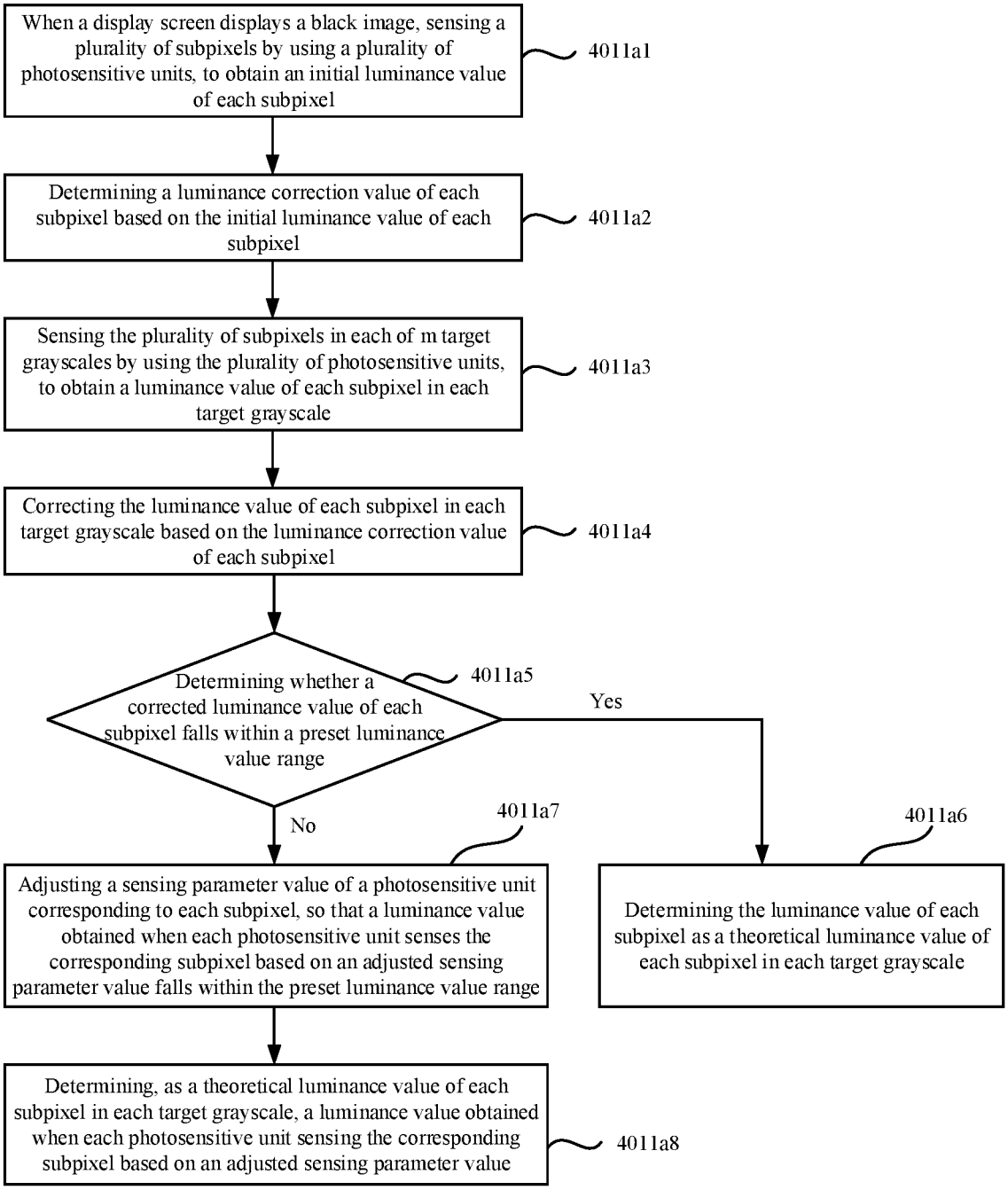
FIG. 6 is a flowchart of a method for determining a theoretical luminance value of a subpixel according to an embodiment of the present disclosure.

For example, FIG. 6 is a flowchart of a method for sensing a subpixel by using a photosensitive unit to obtain a theoretical luminance value of the subpixel according to an embodiment of the present disclosure. The method may include the following steps.

Substep 4011*a*1. When the display screen displays a black image, sense the plurality of subpixels by using the plurality of photosensitive units, to obtain an initial luminance value of each subpixel.

Optionally, a grayscale of the display screen may be adjusted to the grayscale L0, so that the display screen displays the black image. Then the plurality of photosensitive units is controlled to sense the plurality of subpixels. In this case, a luminance value obtained through sensing by each photosensitive unit may be the initial luminance value of the corresponding subpixel. As shown in FIG. 2, the photosensitive unit includes the photosensitive element and the processing element, and the photosensitive element includes the sensor and the sensor switch. Therefore, controlling the photosensitive unit to sense the corresponding subpixel may include: controlling the sensor switch to be closed to enable the sensor to operate, so that the sensor may sense a luminance signal. The processing element processes the luminance signal to obtain a luminance value. It is not difficult to understand based on the sensing circuit shown in FIG. 2 that the luminance signal that is output by the photosensitive element is used to indicate a current signal of the luminance value of the subpixel corresponding to the photosensitive element. A final luminance value of the subpixel is a luminance value obtained by processing the current signal by the processing element.

For example, the display screen includes a subpixel A, a subpixel B, a subpixel C, a subpixel D, and the like. The subpixel A corresponds to a photosensitive unit A, the subpixel B corresponds to a photosensitive unit B, the subpixel C corresponds to a photosensitive unit C, and the subpixel D corresponds to a photosensitive unit D. The subpixel A is sensed by using the photosensitive unit A to obtain an initial luminance value a0 of the subpixel A, the subpixel B is sensed by using the photosensitive unit B to obtain an initial luminance value b0 of the subpixel B, the subpixel C is sensed by using the photosensitive unit C to obtain an initial luminance value c0 of the subpixel C, the subpixel D is sensed by using the photosensitive unit D to obtain an initial luminance value d0 of the subpixel D, and another case can be obtained by analogy.

It should be noted that the photosensitive element outputs the current signal, and a dark current exists in the photosensitive element without light irradiation. Therefore, when the display screen displays the black image, the processing element of the photosensitive unit may determine the luminance value based on the dark current that is output by the photosensitive element. When the display screen displays the black image, the subpixel actually emits no light. Therefore, a luminance value of the subpixel is actually 0. In this embodiment of the present disclosure, the initial luminance value of the subpixel is actually the luminance value obtained through sensing by the photosensitive unit when the display screen displays the black image (in other words, the processing element determines the luminance value based on the dark current that is output by the photosensitive element), rather than the luminance value of the subpixel. In this embodiment of the present disclosure, for convenience of description, the luminance value obtained through sensing by the photosensitive unit when the display screen displays the black image is referred to as the initial luminance value of the subpixel.

Substep 4011*a*2. Determine a luminance correction value of each subpixel based on the initial luminance value of each subpixel.

In this embodiment of the present disclosure, the luminance correction value of each subpixel may be a difference between the initial luminance value of each subpixel and an initial luminance value of a reference subpixel, or may be a difference between the initial luminance value of each subpixel and an average value of initial luminance values of all subpixels of the display screen. It is not difficult to understand that the luminance correction value of each subpixel may be positive, negative, or zero.

In this embodiment of the present disclosure, an example in which the luminance correction value of each subpixel is the difference between the initial luminance value of each subpixel and the initial luminance value of the reference subpixel is used. In this way, for example, if the initial luminance value of the subpixel A is a0, the initial luminance value of the reference subpixel is b0, a0 is greater than b0, and a difference between a0 and b0 is t, a luminance correction value of the subpixel A is −t. For another example, if the initial luminance value of the subpixel B is b0, and the initial luminance value of the reference subpixel is b0, a luminance correction value of the subpixel B is 0 because a difference between the initial luminance value of the subpixel B and the initial luminance value of the reference subpixel is 0. For another example, if the initial luminance value of the subpixel C is c0, the initial luminance value of the reference subpixel is b0, c0 is less than b0, and a difference between c0 and b0 is t, a luminance correction value of the subpixel C is +t. The reference subpixel may be selected depending on an actual case. For example, the reference subpixel is a subpixel having a lowest initial luminance value, or a subpixel having a highest initial luminance value, or any one of the plurality of subpixels of the display screen.

It should be noted that the photosensitive element, the current integrator, the TFT, and the like all have errors. Therefore, the luminance value obtained by sensing the subpixel by the photosensitive unit also have an error. In this embodiment of the present disclosure, the initial luminance value of each subpixel is determined, and the luminance correction value of each subpixel is determined based on the initial luminance value of each subpixel, so as to subsequently correct the luminance value of each subpixel, to eliminate impact of the errors of the photosensitive element, the current integrator, and the TFT on the luminance value of the subpixel obtained through sensing by the photosensitive unit.

Substep 4011*a*3. Sense the plurality of subpixels in each of the m target grayscales by using the plurality of photosensitive units, to obtain a luminance value of each subpixel in each target grayscale.

Optionally, the grayscale of the display screen may be adjusted to a target grayscale. Then the plurality of photosensitive units is controlled to sense the plurality of subpixels. In this case, a luminance value obtained through sensing by each photosensitive unit may be a luminance value of the corresponding subpixel in the target grayscale. A process of controlling the photosensitive unit to sense the corresponding subpixel can be referred to substep 4011*a*1, and is not described herein again in this embodiment of the present disclosure.

For example, the m target grayscales include a grayscale L1, and the grayscale of the display screen may be adjusted to the grayscale L1. Then the plurality of photosensitive units is controlled to sense the plurality of subpixels, to obtain a luminance value of each of the plurality of subpixels in the grayscale L1. For example, in the grayscale L1, a luminance value of the subpixel A is a, a luminance value of the subpixel B is b, a luminance value of the subpixel C is c, and another case can be obtained by analogy.

Substep 4011*a*4. Correct the luminance value of each subpixel in each target grayscale based on the luminance correction value of each subpixel.

Optionally, the luminance value of each subpixel in the target grayscale and the luminance correction value of each subpixel may be added, to correct the luminance value of each subpixel in each target grayscale.

For example, if a luminance correction value of the subpixel A is −t, and a luminance value of the subpixel A in the grayscale L1 is a, the luminance value of the subpixel A in the grayscale L1 is corrected based on the luminance correction value of the subpixel A, so that an obtained corrected luminance value may be a−t. If a luminance correction value of the subpixel B is 0, and a luminance value of the subpixel B in the grayscale L1 is b, the luminance value of the subpixel B in the grayscale L1 is corrected based on the luminance correction value of the subpixel B, so that an obtained corrected luminance value may be b. If a luminance correction value of the subpixel C s+t, and a luminance value of the subpixel C in the grayscale L1 is c, the luminance value of the subpixel C in the grayscale L1 is corrected based on the luminance correction value of the subpixel C, so that an obtained corrected luminance value may be c+t. Another case can be obtained by analogy.

Substep 4011*a*5. Determine whether a corrected luminance value of each subpixel falls within a preset luminance value range. If the luminance value of each subpixel falls within the preset luminance value range, substep 4011*a*6 is performed. If the luminance value of each subpixel falls outside the preset luminance value range, substeps 4011*a*7 and 4011*a*8 are performed.

The preset luminance value range includes a luminance value upper limit and a luminance value lower limit. The corrected luminance value of each subpixel may be separately compared with the luminance value upper limit and the luminance value lower limit. If the luminance value is less than the luminance value upper limit and is greater than the luminance value lower limit, the luminance value falls within the preset luminance value range, in other words, the corrected luminance value of the subpixel falls within the preset luminance value range. If the luminance value is greater than the luminance value upper limit or less than the luminance value lower limit, the luminance value falls outside the preset luminance value range, in other words, the corrected luminance value of the subpixel falls outside the preset luminance value range.

For example, a corrected luminance value of the subpixel A is a−t, and a−t may be separately compared with the luminance value upper limit and the luminance value lower limit. If a−t is less than the luminance value upper limit and greater than the luminance value lower limit, a−t falls within the preset luminance value range, in other words, the corrected luminance value of the subpixel A falls within the preset luminance value range. If a−t is greater than the luminance value upper limit or less than the luminance value lower limit, a−t falls outside the preset luminance value range, in other words, the corrected luminance value of the subpixel A falls outside the preset luminance value range. Processes of determining a corrected luminance value of the subpixel B and a corrected luminance value of the subpixel C are similar thereto, and are not described herein again in this embodiment of the present disclosure.

Substep **4011*a*6**. Determine the luminance value of each subpixel as a theoretical luminance value of each subpixel in each target grayscale.

The luminance value of each subpixel in substep **4011*a*6 is the corrected luminance value of each subpixel in substep 4011*a*4**.

For example, the corrected luminance value a−t of the subpixel A is determined as a theoretical luminance value of the subpixel A in the grayscale L1 (the target grayscale). For another example, the corrected luminance value b of the subpixel B is determined as a theoretical luminance value of the subpixel B in the grayscale L1. For another example, the corrected luminance value c+t of the subpixel C is determined as a theoretical luminance value of the subpixel C in the grayscale L1.

Substep **4011*a*7**. Adjust a sensing parameter value of a photosensitive unit corresponding to each subpixel, so that a luminance value obtained when each photosensitive unit senses the corresponding subpixel based on an adjusted sensing parameter value falls within the preset luminance value range.

The sensing parameter value of the photosensitive unit includes an illumination time and an integration capacitance, and when the sensing parameter value of the photosensitive unit corresponding to each subpixel is adjusted, the illumination time and the integration capacitance of each photosensitive unit may be adjusted based on priorities. Optionally, when the sensing parameter value of the photosensitive unit is adjusted, the priority of the illumination time may be higher than the priority of the integration capacitance, in other words, the illumination time of the photosensitive unit is first adjusted. When the luminance value of the corresponding subpixel can fall within the preset luminance value range by adjusting the illumination time of the photosensitive unit, the integration capacitance of the photosensitive unit may not be adjusted. When the luminance value of the corresponding subpixel can fall outside the preset luminance value range by adjusting the illumination time of the photosensitive unit, the integration capacitance of the photosensitive unit may be adjusted, so that the luminance value of the corresponding subpixel falls within the preset luminance value range. Optionally, the sensing parameter value of the photosensitive unit may be adjusted, while the corresponding subpixel is sensed based on an adjusted sensing parameter value by using the photosensitive unit, until a luminance value obtained by through sensing again falls within the preset luminance value range.

The illumination time of each photosensitive unit is directly proportional to luminance of the corresponding subpixel, in other words, a longer illumination time of each photosensitive unit indicates a larger luminance value obtained by sensing the subpixel corresponding to the photosensitive unit. The integration capacitance of each photosensitive unit is directly proportional to the luminance value upper limit of the preset luminance value range, and is inversely proportional to the lower limit of the preset luminance value range, in other words, a larger integration capacitance of each photosensitive unit indicates a larger preset luminance value range. For example, when the luminance value of the subpixel is greater than the luminance value upper limit of the preset luminance value range, the illumination time of the corresponding photosensitive unit may be shortened based on the priority, to reduce the luminance value of the subpixel obtained through sensing by the photosensitive unit, or increase the integration capacitance of the photosensitive unit, to increase the luminance value upper limit of the preset luminance value range, so that the luminance value obtained by the photosensitive unit sensing the corresponding subpixel based on the adjusted sensing parameter value falls within the preset luminance value range. When the luminance value of the subpixel is less than the luminance value lower limit of the preset luminance value range, the illumination time of the corresponding photosensitive unit may be prolonged based on the priority, to increase the luminance value obtained by the photosensitive unit sensing the subpixel, or reduce the integration capacitance of the photosensitive unit, to reduce the luminance value lower limit of the preset luminance value range, so that the luminance value obtained by the photosensitive unit sensing the corresponding subpixel based on the adjusted sensing parameter value falls within the preset luminance value range.

It should be noted that the integration capacitance has an error. Therefore, after the integration capacitance is adjusted, substeps **4011*a*1 to 4011*a*4** need to be performed to re-correct the luminance value of each subpixel in each target grayscale. In this embodiment of the present disclosure, when the sensing parameter value is adjusted, the priority of the illumination time is set to be higher than the priority of the integration capacitance. In this way, when the luminance value of the subpixel can fall within the preset luminance value range by adjusting the illumination time, the integration capacitance does not need to be adjusted, thereby simplifying sensing and adjustment processes, further simplifying a pixel compensation process, and increasing pixel compensation efficiency.

Substep **4011*a*8**. Determine, as a theoretical luminance value of each subpixel in each target grayscale, a luminance value obtained when each photosensitive unit sensing the corresponding subpixel based on an adjusted sensing parameter value.

For example, if a luminance value obtained by the photosensitive unit A sensing the subpixel A based on an adjusted sensing parameter value is a1, and a1 falls within the preset luminance value range, a1 may be determined as the theoretical luminance value of the subpixel A in the grayscale L1. For another example, if a luminance value obtained by the photosensitive unit B sensing the subpixel B based on an adjusted sensing parameter value is b1, b1 may be determined as the theoretical luminance value of the subpixel B in the grayscale L1. For another example, if a luminance value obtained by the photosensitive unit C sensing the subpixel C based on an adjusted sensing parameter value is c1, c1 may be determined as the theoretical luminance value of the subpixel C in the grayscale L1.

Substep 4012*a*. Determine theoretical luminance values of the plurality of subpixels in each target grayscale as theoretical pixel data corresponding to each target grayscale.

For example, assuming that, in the grayscale L1, the theoretical luminance value of the subpixel A is a1, the theoretical luminance value of the subpixel B is b1, the theoretical luminance value of the subpixel C is c1, and another case can be obtained by analogy, theoretical pixel data corresponding to the grayscale L1 may be indicated by using the following Table 1.

TABLE 1

| Grayscale L1<br>Theoretical pixel data |
|---|
| a1 |
| b1 |
| c1 |
| . . . |

In this embodiment of the present disclosure, description is provided by using the theoretical pixel data corresponding to the grayscale L1 as an example. Theoretical pixel data corresponding to another target grayscale can be referred to Table 1, and is not described herein again in this embodiment of the present disclosure.

Substep 4013*a*. Determine theoretical sensing data corresponding to each target grayscale.

The theoretical sensing data corresponding to each target grayscale includes the theoretical sensing parameter value of each photosensitive unit, and the theoretical sensing parameter value of each photosensitive unit is a sensing parameter value when each photosensitive unit senses the corresponding subpixel in each target grayscale. Optionally, a sensing parameter value of the photosensitive unit when the luminance value of the subpixel obtained through sensing by the photosensitive unit is the theoretical luminance value in each target grayscale may be determined as the theoretical sensing parameter value of the photosensitive unit, and theoretical sensing parameter values of the plurality of photosensitive units in each target grayscale are determined as the theoretical sensing data corresponding to each target grayscale.

For example, assuming that the photosensitive unit A senses the subpixel A in the grayscale L1 to obtain a theoretical luminance value of the subpixel A, a sensing parameter value when the theoretical luminance value obtained through sensing by the photosensitive unit A is determined as a theoretical sensing parameter value of the photosensitive unit A, and the theoretical sensing parameter value of the photosensitive unit A may be Sa1. Another case can be obtained by analogy, and a theoretical sensing parameter value of the photosensitive unit B, a theoretical sensing parameter value of the photosensitive unit C, and the like in the grayscale L1 may be determined. Then the theoretical sensing parameter values of the photosensitive unit A, the photosensitive unit B, the photosensitive unit C, and the like in the grayscale L1 may be determined as theoretical sensing data corresponding to the grayscale L1. Assuming that, in the grayscale L1, the theoretical sensing parameter value of the photosensitive unit A is Sa1, the theoretical sensing parameter value of the photosensitive unit B is Sb1, the theoretical sensing parameter value of the photosensitive unit C is Sc1, and another case can be obtained by analogy, the theoretical sensing data corresponding to the grayscale L1 may be indicated by using the following Table 2.

TABLE 2

| Grayscale L1<br>Theoretical sensing data |
|---|
| Sa1 |
| Sb1 |
| Sc1 |
| . . . |

In this embodiment of the present disclosure, description is provided by using the theoretical sensing data corresponding to the grayscale L1 as an example. Theoretical sensing data corresponding to another target grayscale can be referred to Table 2, and is not described herein again in this embodiment of the present disclosure.

It should be noted that, it is not difficult to understand according to the foregoing description that, when the corrected luminance value of the subpixel determined in substep 4011*a*5 falls within the preset luminance value range, the theoretical sensing parameter value in substep 4013*a* is the sensing parameter value corresponding to the luminance value obtained through sensing by the photosensitive unit in substep 4011*a*3. When the corrected luminance value of the subpixel determined in substep 4011*a*5 falls outside the preset luminance value range, the theoretical sensing parameter value in substep 4013*a* is the adjusted sensing parameter value in sub step 4011*a*7.

Substep 4014*a*. Generate the compensation sensing model based on theoretical pixel data corresponding to the m target grayscales and theoretical sensing data corresponding to the m target grayscales.

Optionally, a correspondence between target grayscales, theoretical pixel data, and theoretical sensing data may be generated based on the theoretical pixel data corresponding to the m target grayscales and the theoretical sensing data corresponding to the m target grayscales, to obtain the compensation sensing model. In addition, after the compensation sensing model is generated, the compensation sensing model may be stored for subsequent use. The compensation sensing model may be stored in the display screen (the display screen may include a storage unit) or any storage device that can communicate with a control IC of the display screen. This is not limited in this embodiment of the present disclosure.

For example, in this embodiment of the present disclosure, the compensation sensing model may be indicated by using the following Table 3.

TABLE 3

| Grayscale L1 | | Grayscale L3 | | Grayscale L5 | | ... | |
|---|---|---|---|---|---|---|---|
| Theoretical pixel data | Theoretical sensing data | Theoretical pixel data | Theoretical sensing data | Theoretical pixel data | Theoretical sensing data | ... | ... |
| a1 | Sa1 | a3 | Sa3 | a5 | Sa5 | ... | ... |
| b1 | Sb1 | b3 | Sb3 | b5 | Sb5 | ... | ... |
| c1 | Sc1 | c3 | Sc3 | c5 | Sc5 | ... | ... |
| ... | ... | ... | ... | ... | ... | ... | ... |

Figure 7:
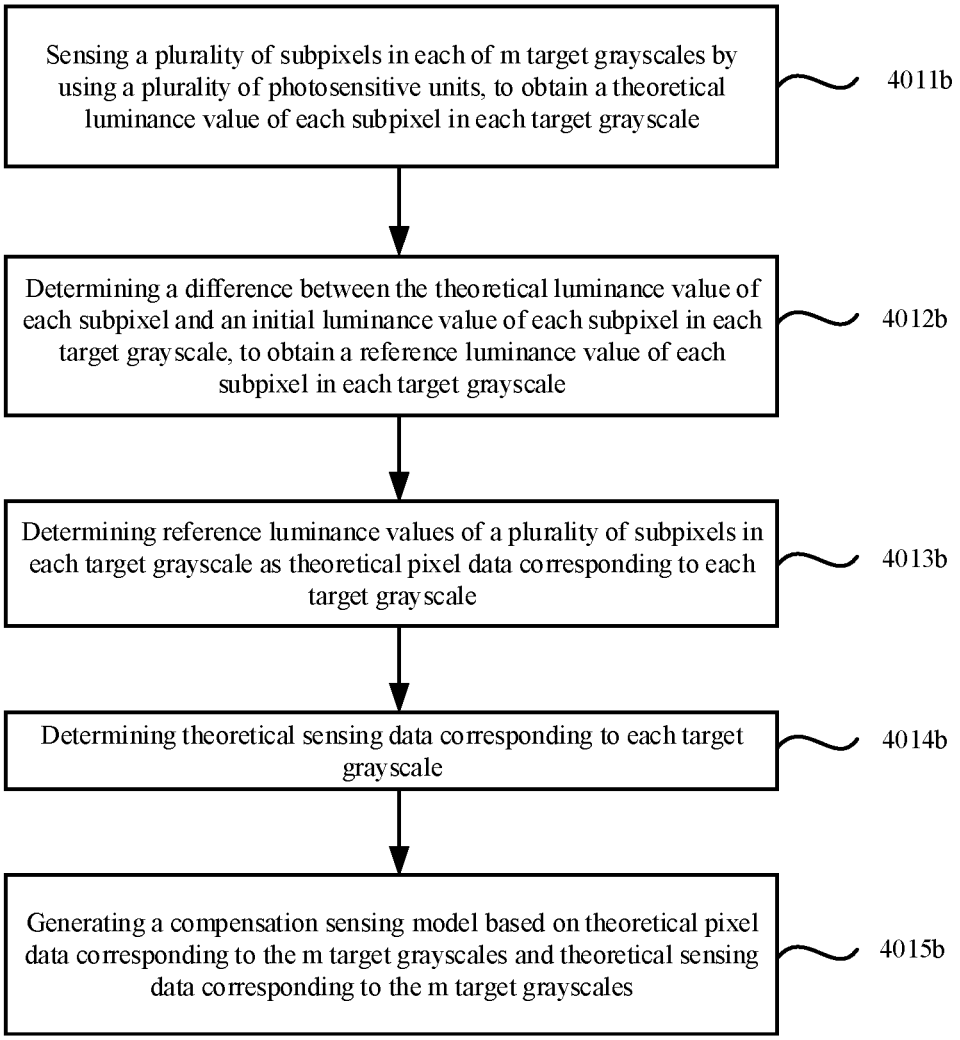
FIG. 7 is a flowchart of another method for generating a compensation sensing model according to an embodiment of the present disclosure.

In a second implementation of step 401, the reference luminance value is the difference between the theoretical luminance value and the initial luminance value. The initial luminance value of each subpixel is the luminance value obtained through sensing by the corresponding photosensitive unit when the display screen displays the black image. In this way, FIG. 7 is a flowchart of another method for generating a compensation sensing model according to an embodiment of the present disclosure. The method may include the following steps.

Substep 4011*b*. Sense the plurality of subpixels in each of them target grayscales by using the plurality of photosensitive units, to obtain a theoretical luminance value of each subpixel in each target grayscale.

A process of implementing substep 4011*b* can be referred to the process of implementing substep 4011*a*, and is not described herein again in this embodiment of the present disclosure.

Substep 4012*b*. Determine a difference between the theoretical luminance value of each subpixel in each target grayscale and the initial luminance value of each subpixel, to obtain a reference luminance value of each subpixel in each target grayscale.

The initial luminance value of each subpixel may be subtracted from the theoretical luminance value of each subpixel in each target grayscale to obtain the difference therebetween, and the difference is used as the reference luminance value of each subpixel in each target grayscale.

For example, if an initial luminance value of a subpixel A is a0, and a theoretical luminance value of the subpixel A in a grayscale L1 is a1, a reference luminance value of the subpixel A in the grayscale L1 is $\Delta a1=a1-a0$. If an initial luminance value of a subpixel B is b0, and a theoretical luminance value of the subpixel B in the grayscale L1 is b1, a reference luminance value of the subpixel B in the grayscale L1 is $\Delta b1=b1-b0$. If an initial luminance value of a subpixel C is c0, and a theoretical luminance value of the subpixel C in the grayscale L1 is c1, a reference luminance value of the subpixel C in the grayscale L1 is $\Delta c1=c1-c0$. Another case can be obtained by analogy. A process of determining a reference luminance value of each subpixel in another target grayscale is similar thereto, and is not described herein again in this embodiment of the present disclosure.

Substep 4013*b*. Determine reference luminance values of the plurality of subpixels in each target grayscale as theoretical pixel data corresponding to each target grayscale.

For example, if in the grayscale L1, the reference luminance value of the subpixel A is a1, the reference luminance value of the subpixel B is b1, the reference luminance value of the subpixel C is c1, and another case can be obtained by analogy, theoretical pixel data corresponding to the grayscale L1 may be indicated by using the following Table 4.

TABLE 4

| Grayscale L1 Theoretical pixel data |
|---|
| Δa1 |
| Δb1 |
| Δc1 |
| ... |

In this embodiment of the present disclosure, description is provided by using the theoretical pixel data corresponding to the grayscale L1 as an example. Theoretical pixel data corresponding to another target grayscale can be referred to Table 4, and is not described herein again in this embodiment of the present disclosure.

Substep 4014*b*. Determine theoretical sensing data corresponding to each target grayscale.

The theoretical sensing data corresponding to each target grayscale includes a theoretical sensing parameter value of each photosensitive unit, and the theoretical sensing parameter value of each photosensitive unit is a sensing parameter value when each photosensitive unit senses a corresponding subpixel in each target grayscale. A process of implementing substep 4014*b* can be referred to the process of implementing substep 4013*a*, and is not described herein again in this embodiment of the present disclosure.

Substep 4015*b*. Generate the compensation sensing model based on theoretical pixel data corresponding to the m target grayscales and theoretical sensing data corresponding to the m target grayscales.

A process of implementing substep 4015*b* can be referred to the process of implementing substep 4014*a*. A difference lies in that the theoretical pixel data in the compensation sensing model in substep 4015*b* includes the reference luminance values of the plurality of subpixels, and the reference luminance value is a difference between a theoretical luminance value and an initial luminance value of a corresponding subpixel. For example, the compensation sensing model generated in substep 4015*b* may be indicated by using the following Table 5.

TABLE 5

| Grayscale L1 | | Grayscale L3 | | Grayscale L5 | | ... | |
|---|---|---|---|---|---|---|---|
| Theoretical pixel data | Theoretical sensing data | Theoretical pixel data | Theoretical sensing data | Theoretical pixel data | Theoretical sensing data | ... | ... |
| Δa1 | Sa1 | Δa3 | Sa3 | Δa5 | Sa5 | ... | ... |
| Δb1 | Sb1 | Δb3 | Sb3 | Δb5 | Sb5 | ... | ... |
| Δc1 | Sc1 | Δc3 | Sc3 | Δc5 | Sc5 | ... | ... |
| ... | ... | ... | ... | ... | ... | ... | ... |

It should be noted that the theoretical pixel data in the compensation sensing model in the second implementation includes the difference between the theoretical luminance value of the subpixel and the initial luminance value of the subpixel, but the theoretical pixel data in the compensation sensing model in the first implementation includes the theoretical luminance value of the subpixel. Compared with the first implementation, the compensation sensing model has a relatively small data volume in the second implementation, so that storage space occupied by the compensation sensing model can be effectively reduced. For example, in the first implementation, each piece of data (that is, the theoretical luminance value) in the theoretical pixel data recorded in the compensation sensing model is 16 bits. In the second implementation, each piece of data (that is, the difference between the theoretical luminance value and the initial luminance value) in the theoretical pixel data recorded in the compensation sensing model is 8 bits. In this way, a data volume in the compensation sensing model generated in the second implementation is half data volume in the compensation sensing model generated in the first implementation. Therefore, the storage space occupied by the compensation sensing model can be halved in the second implementation.

It should be further noted that, in practical applications, in the foregoing process of generating the compensation sensing model, theoretical pixel data and theoretical sensing data that correspond to some of the m target grayscales may be determined, and the theoretical pixel data corresponding to the some target grayscales fits with the theoretical sensing data corresponding to the some target grayscales, to obtain theoretical pixel data and theoretical sensing data that correspond to the others of the m target grayscales, to save a time for generating the compensation sensing model. Optionally, the theoretical pixel data corresponding to the target grayscales may linearly fit with the theoretical sensing data corresponding to the target grayscales, to obtain the theoretical pixel data and the theoretical sensing data that correspond to the others of the m target grayscales.

Step 402. Determine theoretical sensing data corresponding to a first target grayscale of the display screen from the compensation sensing model.

The first target grayscale is any one of the m target grayscales, and the m target grayscales are m target grayscales in the compensation sensing model. It may be learned according to the description in step 401 that the compensation sensing model records the one-to-one correspondence between target grayscales, theoretical pixel data, and theoretical sensing data. Therefore, the compensation sensing model may be queried based on the first target grayscale, to obtain the theoretical sensing data corresponding to the first target grayscale. For example, if the first target grayscale is a grayscale L1, the theoretical sensing data that corresponds to the first target grayscale and that is obtained by querying the compensation sensing model based on the first target grayscale may be shown in the foregoing Table 2.

Step 403. Adjust the sensing parameter value of each photosensitive unit based on the theoretical sensing data corresponding to the first target grayscale, so that the sensing parameter value of each photosensitive unit is a theoretical sensing parameter value.

The theoretical sensing parameter value of each photosensitive unit may be determined from the theoretical sensing data corresponding to the first target grayscale, and then the sensing parameter value of each photosensitive unit is adjusted to the theoretical sensing parameter value.

For example, if the theoretical sensing data corresponding to the grayscale L1 is shown in FIG. 2, it may be determined from the theoretical sensing data shown in FIG. 2 that the theoretical sensing parameter value of the photosensitive unit A is Sa1, the theoretical sensing parameter value of the photosensitive unit B is Sb1, the theoretical sensing parameter value of the photosensitive unit C is Sc1. Then a sensing parameter value of the photosensitive unit A is adjusted to Sa1, a sensing parameter value of the photosensitive unit B is adjusted to Sb1, a sensing parameter value of the photosensitive unit C is adjusted to Sc1, and another case can be obtained by analogy.

It should be noted that the sensing parameter value includes an illumination time and an integration capacitance. In step 403, both the illumination time and the integration capacitance of the photosensitive unit may be adjusted.

Step 404. Sense the plurality of subpixels in the first target grayscale based on the corresponding theoretical sensing parameter values by using the plurality of photosensitive units, to obtain an actual luminance value of each subpixel.

Optionally, a grayscale of the display screen may be adjusted to the first target grayscale. Then the plurality of photosensitive units is controlled to sense the plurality of subpixels. In this case, a luminance value obtained through sensing by each photosensitive unit may be an actual luminance value of the corresponding subpixel in the target grayscale. For example, in the grayscale L1, an actual luminance value of the subpixel A is a1', an actual luminance value of the subpixel B is b1', an actual luminance value of the subpixel C is c1', and another case can be obtained by analogy.

Step 405. Determine a reference luminance value of each subpixel in the first target grayscale based on the compensation sensing model.

In this embodiment of the present disclosure, the theoretical pixel data corresponding to each target grayscale in the compensation sensing model includes a reference luminance value of each subpixel in each target grayscale. Therefore, the compensation sensing model may be queried based on the first target grayscale, to obtain theoretical pixel data corresponding to the first target grayscale. Then the reference luminance value of each subpixel in the first target grayscale is determined from the theoretical pixel data corresponding to the first target grayscale.

The reference luminance values determined in step 405 are different in the two implementations in step 401. An example in which the first target grayscale is the grayscale L1, and the plurality of subpixels of the display screen include a subpixel A, a subpixel B, a subpixel C, and the like is used. In this way, step 405 may include either of the following two implementations.

In a first implementation (corresponding to the first implementation in step 401), the reference luminance value is the theoretical luminance value. In this way, the theoretical pixel data corresponding to the first target grayscale determined in step 405 may be shown in the foregoing Table 1, it may be determined from the theoretical pixel data shown in FIG. 1 that in the grayscale L1, a reference luminance value of the subpixel A is a1, a reference luminance value of the subpixel B is b1, a reference luminance value of the subpixel C is c1, and another case can be obtained by analogy.

In a second implementation (corresponding to the second implementation in step 401), the reference luminance value is the difference between the theoretical luminance value and the initial luminance value. In this way, the theoretical pixel data corresponding to the first target grayscale determined in step 405 may be shown in the foregoing Table 4, it is determined from the theoretical pixel data shown in the foregoing Table 4 that in the grayscale L1, a reference luminance value of the subpixel A is Δa1, a reference luminance value of the subpixel B is Δb1, a reference luminance value of the subpixel C is Δc1, and another case can be obtained by analogy.

Step 406. Determine a theoretical luminance value of each subpixel based on the reference luminance value of each subpixel.

For the two implementations in step 401, step 406 of determining a theoretical luminance value of each subpixel based on the reference luminance value of each subpixel may include either of the following two implementations.

In a first implementation (corresponding to the first implementation in step 401), the reference luminance value is the theoretical luminance value. In this way, the reference luminance value of each subpixel may be directly determined as the theoretical luminance value of each subpixel. For example, if it is determined in step 405 that the reference luminance value of the subpixel A is a1, the reference luminance value of the subpixel B is b1, and the reference luminance value of the subpixel C is c1, a1 may be determined as a theoretical luminance value of the subpixel A, b1 may be determined as a theoretical luminance value of the subpixel B, and c1 may be determined as a theoretical luminance value of the subpixel C.

In a second implementation (corresponding to the second implementation in step 401), the reference luminance value is the difference between the theoretical luminance value and the initial luminance value. In this way, a sum of the reference luminance value and the initial luminance value of each subpixel may be determined as the theoretical luminance value of each subpixel. For example, it is determined in step 405 that the reference luminance value of the subpixel A is Δa1, the reference luminance value of the subpixel B is Δb1, and the reference luminance value of the subpixel C is Δc1. It may be learned according to substep **4011*a*1 that the initial luminance value of the subpixel A is a0, the initial luminance value of the subpixel B is b0, and the initial luminance value of the subpixel C is c0. In this way, Δa1+a0=a1 (details can be referred to substep 4012*b*) may be determined as a theoretical luminance value of the subpixel A, Δb1+b0=b1 (details can be referred to substep 4012*b*) may be determined as a theoretical luminance value of the subpixel B, and Δc1+c0=c1 (details can be referred to substep 4012*b***) may be determined as a theoretical luminance value of the subpixel C.

The theoretical luminance value of each subpixel in the first target grayscale may be determined based on the compensation sensing model according to the foregoing steps 405 and 406.

Step 407. Perform pixel compensation on each subpixel based on the actual luminance value of each subpixel and the theoretical luminance value of each subpixel.

Figure 8:
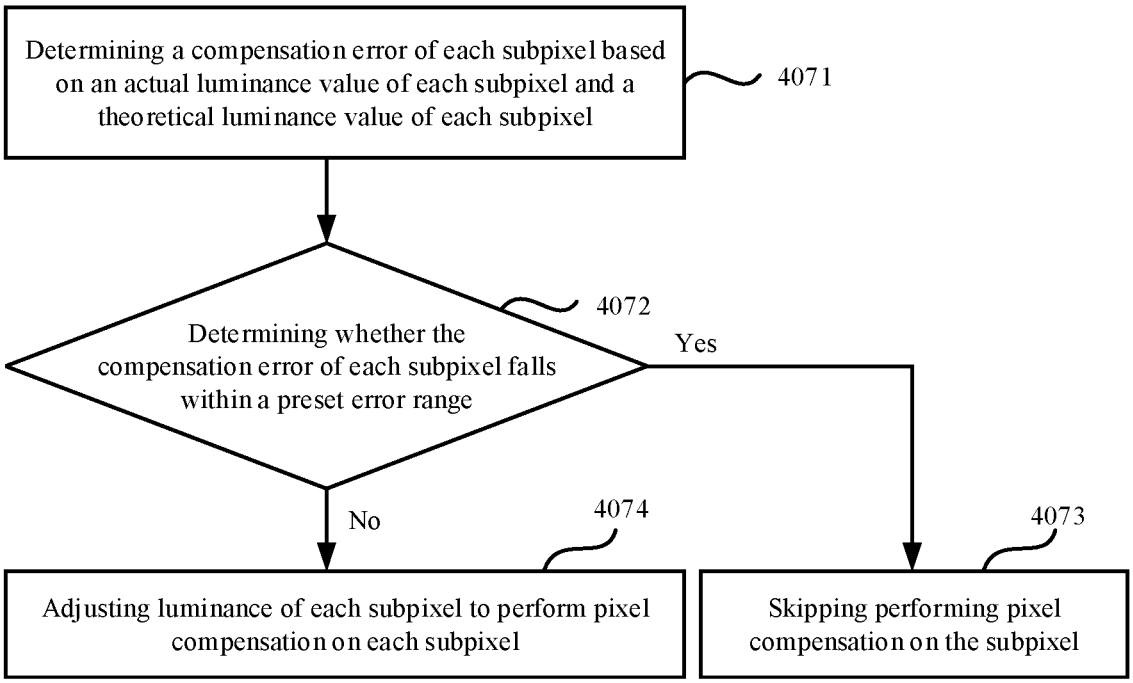
FIG. 8 is a flowchart of a method for performing pixel compensation on a subpixel according to an embodiment of the present disclosure.

Optionally, FIG. 8 is a flowchart of a method for performing pixel compensation on a subpixel according to an embodiment of the present disclosure. The method may include the following steps.

Substep 4071. Determine a compensation error of each subpixel based on the actual luminance value of each subpixel and the theoretical luminance value of each subpixel.

In this embodiment of the present disclosure, the compensation error may be determined according to a compensation error formula. The compensation error formula may be ΔE=k×x'−x, where ΔE denotes the compensation error, x' denotes the actual luminance value, x denotes the theoretical luminance value, k is a compensation factor, and k is a constant greater than 0. The actual luminance value and the theoretical luminance value of each subpixel may be substituted into the compensation error formula for calculation, to obtain the compensation error of each subpixel.

For example, if an actual luminance value of the subpixel A is a1', a theoretical luminance value is a1, a1' and a1 are substituted into ΔE=k×x'−x, so that a compensation error of the subpixel A can be obtained as follows: ΔEa=k×a1'−a1. If an actual luminance value of the subpixel B is b1', and a theoretical luminance value is b1, b1' and b1 are substituted into ΔE=k×x'−x, so that a compensation error of the subpixel B can be obtained as follows: ΔEb=k×b1'−b1. Another case can be obtained by analogy.

Substep 4072. Determine whether the compensation error of each subpixel falls within a preset error range. When the compensation error of the subpixel falls within the preset error range, substep 4073 is performed. When the compensation error of the subpixel falls outside the preset error range, substep 4074 is performed.

A process of implementing substep 4072 can be referred to the process of implementing substep **4011*a*5**, and is not described herein again in this embodiment of the present disclosure.

For example, a preset compensation error range may be −3 to +3, and may be set according to an actual requirement. This is not limited in this embodiment of the present disclosure.

Substep 4073. Skip performing pixel compensation on the subpixel.

If the compensation error of the subpixel determined in substep 4072 falls within the preset error range, no pixel compensation may be performed on the subpixel.

Substep 4074. Adjust luminance of each subpixel to perform pixel compensation on each subpixel.

Optionally, if the compensation error of the subpixel falls outside the preset error range, the luminance of the subpixel may be gradually increased or decreased, until the actual luminance value of the subpixel is equal to the theoretical luminance value of the subpixel, or the compensation error of the subpixel falls within the preset error range. The luminance of the subpixel may be gradually increased or decreased at a ratio or based on a luminance value. The ratio may be 5% (percent), 10%, 20%, or the like. The luminance value may be 1, 2, 3, 4, or the like. When the actual luminance value of the subpixel is less than the theoretical luminance value, the luminance of the subpixel is gradually increased. When the actual luminance value of the subpixel is greater than the theoretical luminance value, the luminance of the subpixel is gradually decreased.

For example, assuming that a compensation error ΔEa of the subpixel A falls outside the preset error range, and an actual luminance value a1' of the subpixel A is greater than a theoretical luminance value a1, luminance of the subpixel A may be gradually decreased at the ratio of 5%, so that the actual luminance value of the subpixel A is equal to the theoretical luminance value a1 of the subpixel A, or so that the compensation error of the subpixel A falls within the preset error range. Assuming that a compensation error ΔEa of the subpixel A falls outside the preset error range, and an actual luminance value a1' of the subpixel A is less than a theoretical luminance value a1, the luminance of the subpixel A may be gradually increased at the ratio of 10%, so that the actual luminance value of the subpixel A is equal to the theoretical luminance value a1 of the subpixel A, or so that the compensation error of the subpixel A falls within the preset error range.

For example, assuming that a compensation error ΔEb of the subpixel B falls outside the preset error range, and an actual luminance value b1' of the subpixel B is greater than a theoretical luminance value b1, luminance of the subpixel B may be gradually decreased based on the luminance value 2, so that the actual luminance value of the subpixel B is equal to the theoretical luminance value b1 of the subpixel B, or so that the compensation error of the subpixel B falls within the preset error range. Assuming that a compensation error ΔEb of the subpixel B falls outside the preset error range, and an actual luminance value b1' of the subpixel B is less than a theoretical luminance value b1, the luminance of the subpixel B may be gradually increased based on the luminance value 2, so that the actual luminance value of the subpixel B is equal to the theoretical luminance value b1 of the subpixel B, or so that the compensation error of the subpixel B falls within the preset error range.

It should be noted that the process of adjusting the luminance of each subpixel in sub step 4074 may be implemented by adjusting a voltage or current that is input into a driving circuit of the subpixel. For example, when luminance of a subpixel needs to be increased, a voltage or current that is input into a driving circuit of the subpixel may be increased; when luminance of a subpixel needs to be decreased, a voltage or current that is input into a driving circuit of the subpixel may be decreased.

Step 408. Update the reference luminance value in the compensation sensing model.

For the two implementations in step 401, step 408 of updating the reference luminance value in the compensation sensing model may include either of the following two implementations.

In a first implementation (corresponding to the first implementation in step 401), the reference luminance value is the theoretical luminance value.

Figure 9:
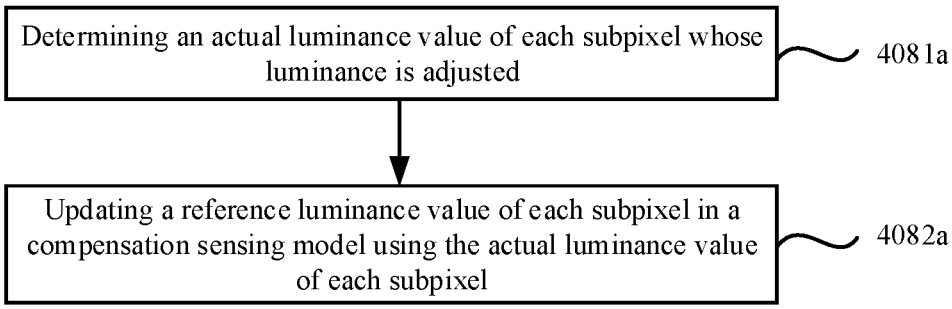
FIG. 9 is a flowchart of a method for updating a compensation sensing model according to an embodiment of the present disclosure.

FIG. 9 is a flowchart of a method for updating a compensation sensing model according to an embodiment of the present disclosure. The method may include the following steps.

Substep 4081*a*. Determine an actual luminance value of each subpixel whose luminance is adjusted.

It is easily understood according to the description in step 407 that, in the process of performing step 407, the actual luminance value of each subpixel whose luminance is adjusted may be already determined. For example, an actual luminance value of the subpixel A whose luminance is adjusted is a2, an actual luminance value of the subpixel B whose luminance is adjusted is b2, an actual luminance value of the subpixel C whose luminance is adjusted is c2, and another case can be obtained by analogy.

Substep 4082*a*. Update the reference luminance value of each subpixel in the compensation sensing model using the actual luminance value of each subpixel.

Optionally, for the reference luminance value of the subpixel that needs to be updated, the actual luminance value of the subpixel may be used to cover the reference luminance value of the subpixel in the compensation sensing model, to update the reference luminance value of the subpixel.

For example, it may be learned according to Table 3 in substep 4014*a* that, in the grayscale L1 in the compensation sensing model, a reference luminance value of the subpixel A is a1, a reference luminance value of the subpixel B is b1, and a reference luminance value of the subpixel C is c1. In this way, the reference luminance value a1 of the subpixel Ain the compensation sensing model may be used to cover the actual luminance value a2 that is determined in substep 4081*a* and that is of the subpixel A whose luminance is adjusted, the reference luminance value b1 of the subpixel B in the compensation sensing model may be used to cover the actual luminance value b2 that is determined in substep 4081*a* and that is of the subpixel B whose luminance is adjusted, the reference luminance value c1 of the subpixel C in the compensation sensing model may be used to cover the actual luminance value c2 that is determined in substep 4081*a* and that is of the subpixel C whose luminance is adjusted, and another case can be obtained by analogy. Assuming that all reference luminance values in the compensation sensing model are updated, an updated compensation sensing model may be indicated by using the following Table 6.

TABLE 6

| Grayscale L1 | | Grayscale L3 | | Grayscale L5 | | | |
|---|---|---|---|---|---|---|---|
| Theoretical pixel data | Theoretical sensing data | Theoretical pixel data | Theoretical sensing data | Theoretical pixel data | Theoretical sensing data | ... | ... |
| a2 | Sa1 | a4 | Sa3 | a6 | Sa5 | ... | ... |
| b2 | Sb1 | b4 | Sb3 | b6 | Sb5 | ... | ... |
| c2 | Sc1 | c4 | Sc3 | c6 | Sc5 | ... | ... |
| ... | ... | ... | ... | ... | ... | ... | ... |

In a second implementation (corresponding to the second implementation in step 401), the reference luminance value is the difference between the theoretical luminance value and the initial luminance value.

Figure 10:
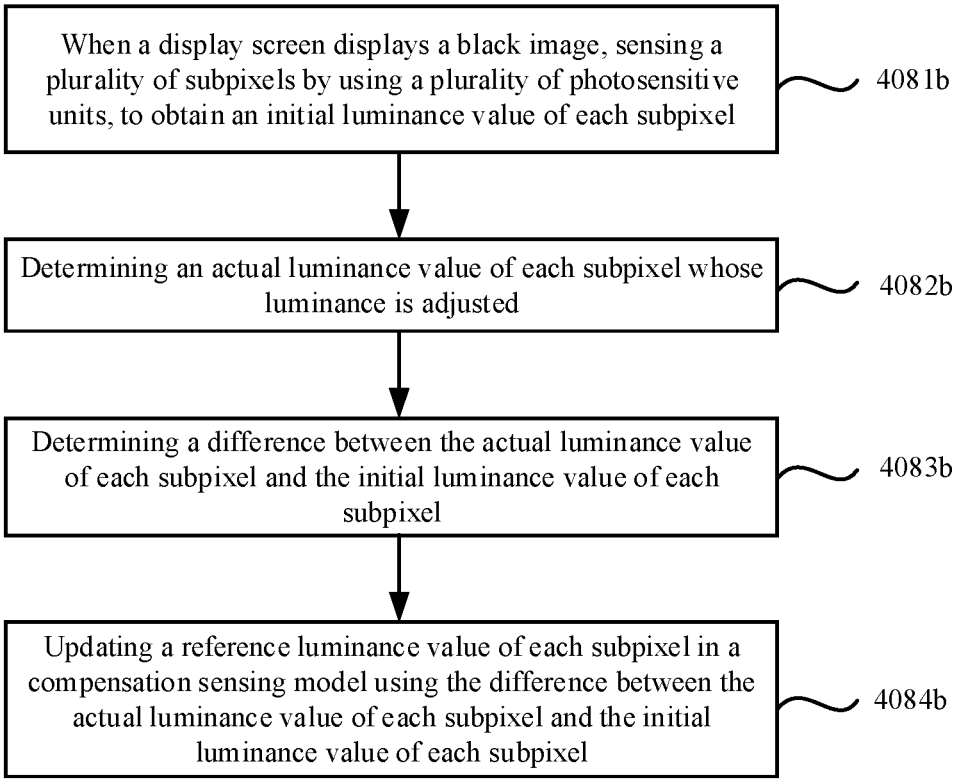
FIG. 10 is a flowchart of another method for updating a compensation sensing model according to an embodiment of the present disclosure.

When the reference luminance value of each subpixel recorded in the generated compensation sensing model is the difference between the theoretical luminance value and the initial luminance value, FIG. 10 is a flowchart of another method for updating a compensation sensing model according to an embodiment of the present disclosure. The method may include the following steps.

Substep 4081*b*. When the display screen displays a black image, sense the plurality of subpixels by using the plurality of photosensitive units, to obtain the initial luminance value of each subpixel. A process of implementing substep 4081*b* can be referred to substep 4011*a*1, and is not described herein again in this embodiment of the present disclosure.

Substep 4082*b*. Determine an actual luminance value of each subpixel whose luminance is adjusted. A process of implementing substep 4082*b* can be referred to substep 4081*a*, and is not described herein again in this embodiment of the present disclosure.

Substep 4083*b*. Determine a difference between the actual luminance value of each subpixel and the initial luminance value of each subpixel. A process of implementing substep 4083*b* can be referred to substep 4012*b*, and is not described herein again in this embodiment of the present disclosure.

Substep 4084*b*. Update a reference luminance value of each subpixel in the compensation sensing model using the difference between the actual luminance value of each subpixel and the initial luminance value of each subpixel.

Optionally, for the reference luminance value of the subpixel that needs to be updated, the difference between the actual luminance value and the initial luminance value of the subpixel may be used to cover the reference luminance value of the subpixel in the compensation sensing model, to update the reference luminance value of the subpixel.

For example, it may be learned according to Table 5 in substep 4015*b* that, in the compensation sensing model, a reference luminance value of the subpixel A is Δa1, a reference luminance value of the subpixel B is Δb1, and a reference luminance value of the subpixel C is Δc1. It is assumed that a difference between an actual luminance value determined in substep 4082*b* of the subpixel A and an initial luminance value is Δa2, a difference between an actual luminance value and an initial luminance value of the subpixel B is Δb2, a difference between an actual luminance value and an initial luminance value of the subpixel C is Δc2, and another case can be obtained by analogy. In this way, the difference Δa2 between the actual luminance value and the initial luminance value of the subpixel A may be used to cover the reference luminance value Δa1 of the subpixel A in the compensation sensing model, the difference Δb2 between the actual luminance value and the initial luminance value of the subpixel B may be used to cover the reference luminance value Δb1 of the subpixel B in the compensation sensing model, the difference Δc2 between the actual luminance value and the initial luminance value of the subpixel C may be used to cover the reference luminance value Δc1 of the subpixel C in the compensation sensing model, and another case can be obtained by analogy. Assuming that all reference luminance values in the compensation sensing model are updated, an updated compensation sensing model may be indicated by using the following Table 7.

TABLE 7

| Grayscale L1 | | Grayscale L3 | | Grayscale L5 | | | |
|---|---|---|---|---|---|---|---|
| Theoretical pixel data | Theoretical sensing data | Theoretical pixel data | Theoretical sensing data | Theoretical pixel data | Theoretical sensing data | ... | ... |
| Δa2 | Sa1 | Δa4 | Sa3 | Δa6 | Sa5 | ... | ... |
| Δb2 | Sb1 | Δb4 | Sb3 | Δb6 | Sb5 | ... | ... |
| Δc2 | Sc1 | Δc4 | Sc3 | Δc6 | Sc5 | ... | ... |
| ... | ... | ... | ... | ... | ... | ... | ... |

It should be noted that, in this embodiment of the present disclosure, the reference luminance value in the compensation sensing model is updated, so that an updated reference luminance value is more aligned with an actual display effect. In this way, accuracy of subsequently performing pixel compensation on a subpixel may be improved.

It should be further noted that, in practical applications, the display screen is usually lighted up row by row. In the solution provided in this embodiment of the present disclosure, when pixel compensation is performed, after a row of subpixels are lighted up, pixel compensation may be performed on the row of subpixels (in other words, pixel compensation is performed while the display screen is lighted up). Alternatively, after all subpixels of the display screen are lighted up, pixel compensation is performed on the display screen. This is not limited in this embodiment of the present disclosure. In addition, when pixel compensation is performed, timing compensation or real-time compensation may be performed while the display screen is working. During the timing compensation, pixel compensation may be performed when the display screen is turned on or off. The timing compensation is not limited by an illumination time. Therefore, a subpixel may be quickly compensated. For the real-time compensation, pixel compensation may be performed within a non-driving time of a subpixel. The non-driving time is a blanking time between two consecutive images when the display screen displays an image. The display screen dynamically scans a frame of image by using a scanning point to display the frame of image. The scanning process starts from an upper left corner of the frame of image and moves forward horizontally, while the scanning point also moves downwards at a slower speed. When the scanning point reaches a right edge of the image, the scanning point quickly returns to a left side, and restarts scanning a second row of pixels under a starting point of a first row of pixels. After completing scanning of the frame of image, the scanning point returns from a lower right corner of the image to the upper left corner of the image to start scanning a next frame of image. A time interval of returning from the lower right corner of the image to the upper left corner of the image is the blanking interval between two consecutive images. In the timing compensation scheme and the real-time compensation scheme, the timing compensation scheme can effectively adjust an illumination time of a photosensitive unit, so that the photosensitive unit can perform more accurate sensing, and quickly perform pixel compensation on aging subpixels of the display screen. The real-time compensation scheme may perform pixel compensation on the aging subpixel of the display screen within a short time. In addition, in the real-time compensation scheme, the display screen has been displaying the image all the time, so that the photosensitive unit has been sensing a corresponding subpixel. Therefore, before performing pixel compensation, the photosensitive unit can be restored to an initial setting within the non-driving time, to prevent data (that is, luminance values) in a plurality of compensation processes from interfering with each other. The real-time compensation can be performed to compensate subpixels when an image displayed by the display screen is not uniform within a short time in a display process.

It should be finally noted that an order of the steps of the pixel compensation method provided in the embodiments of the present disclosure may be properly adjusted, and the steps may also be increased or decreased according to a case. Method to which mortifications readily figured out by those skilled in the art within the technical scope disclosed by the present disclosure shall fall within the protection scope of the present disclosure. Therefore, details are not described herein.

To sum up, in the pixel compensation method provided in the embodiments of the present disclosure, the theoretical luminance value of the subpixel is obtained based on the generated compensation sensing model, and the display screen senses the subpixel by using the photosensitive unit based on the theoretical sensing parameter value recorded in the compensation sensing model, to obtain the actual luminance value of the subpixel, and then compensates the subpixel based on the theoretical luminance value and the actual luminance value of the subpixel, thereby implementing pixel compensation during use of the display screen. In this way, compensation may be performed for an aging display screen, and uniformity of an image displayed by the display screen is enhanced. Further, in the process of generating the compensation sensing model, the theoretical luminance value of the subpixel is corrected by using the initial luminance value of the subpixel obtained through sensing when the display screen displays the black image, so that accuracy of the compensation sensing model can be improved. In addition, after the subpixel is compensated, the reference luminance value of the subpixel in the compensation sensing model can be updated using the actual luminance value of the subpixel, to improve accuracy of subsequently compensating the subpixel.

Figure 11:
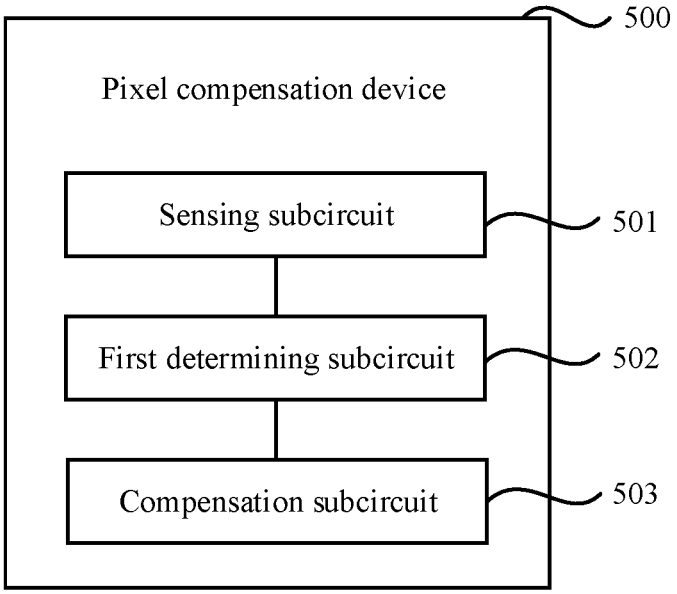
FIG. 11 is a block diagram of a pixel compensation device according to an embodiment of the present disclosure.

An embodiment of the present disclosure provides a pixel compensation device 500, applied to a display screen. The display screen includes a plurality of subpixels and a plurality of photosensitive units in a one-to-one correspondence with the plurality of subpixels, and each photosensitive unit is used to sense a corresponding subpixel. In this way, FIG. 11 is a block diagram of a pixel compensation device according to an embodiment of the present disclosure. The pixel compensation device 500 includes:

a sensing subcircuit 501, used to sense the plurality of subpixels in a first target grayscale of the display screen by using the plurality of photosensitive units, to obtain an actual luminance value of each subpixel;

a first determining subcircuit 502, used to determine a theoretical luminance value of each subpixel in the first target grayscale based on a compensation sensing model, where the compensation sensing model is used to record a correspondence between target grayscales and theoretical pixel data, the theoretical pixel data includes a reference luminance value of each subpixel, and the theoretical luminance value of each subpixel is in a one-to-one correspondence with the reference luminance value of each subpixel; and a compensation subcircuit 503, used to perform pixel compensation on each subpixel based on the actual luminance value of each subpixel and the theoretical luminance value of each subpixel.

To sum up, in the pixel compensation device provided in this embodiment of the present disclosure, the display screen may sense the subpixel by using the sensing subcircuit, to obtain the actual luminance value of the subpixel, obtain the theoretical luminance value of the subpixel by using the first determining subcircuit and a second determining subcircuit, and then compensate the subpixel based on the theoretical luminance value and the actual luminance value of the subpixel by using the compensation subcircuit, thereby implementing pixel compensation during use of the display screen. In this way, compensation may be performed for an aging display screen, and uniformity of an image displayed by the display screen is enhanced.

Optionally, the compensation subcircuit 503 is used to:

determine a compensation error of each subpixel based on the actual luminance value of each subpixel and the theoretical luminance value of each subpixel;

determine whether the compensation error of each subpixel falls within a preset error range; and if the compensation error of each subpixel falls outside the preset error range, adjust luminance of each subpixel to perform pixel compensation on each subpixel.

The compensation sensing model is used to record a one-to-one correspondence between target grayscales, theoretical pixel data, and theoretical sensing data, the theoretical sensing data includes a theoretical sensing parameter value of each photosensitive unit, and the theoretical sensing parameter value of each photosensitive unit is a sensing parameter value when each photosensitive unit senses the corresponding subpixel.

Figure 12:
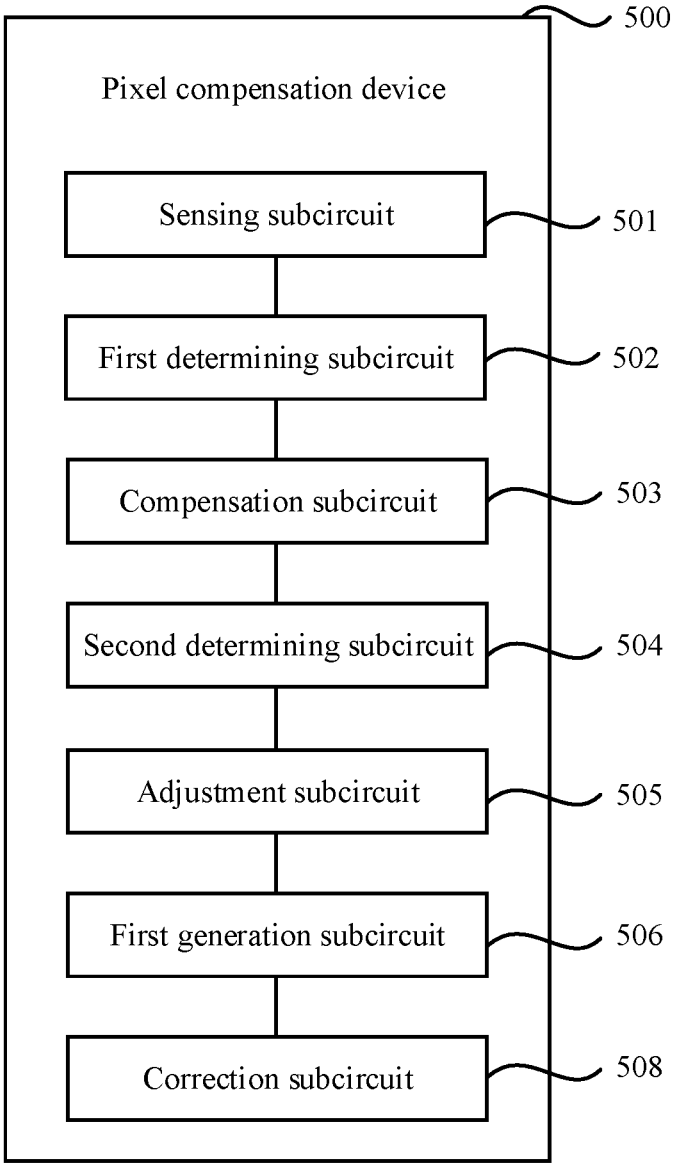
FIG. 12 is a block diagram of another pixel compensation device according to an embodiment of the present disclosure.

Optionally, FIG. 12 is a block diagram of another pixel compensation device according to an embodiment of the present disclosure. The pixel compensation device 500 further includes:

a second determining subcircuit 504, used to determine theoretical sensing data corresponding to a first target grayscale from the compensation sensing model before the plurality of subpixels are sensed in the first target grayscale of the display screen by using the plurality of photosensitive units to obtain the actual luminance value of each subpixel; and an adjustment subcircuit 505, used to adjust the sensing parameter value of each photosensitive unit based on the theoretical sensing data corresponding to the first target grayscale, so that the sensing parameter value of each photosensitive unit is the theoretical sensing parameter value.

Optionally, the sensing subcircuit 501 is used to sense the plurality of subpixels in the first target grayscale based on corresponding theoretical sensing parameter values by using the plurality of photosensitive units, to obtain the actual luminance value of each subpixel.

The display screen has m target grayscales, the first target grayscale is any one of the m target grayscales, m is an integer greater than or equal to 1, the reference luminance value may be the theoretical luminance value or a difference between the theoretical luminance value and an initial luminance value, and the initial luminance value of each subpixel is a luminance value obtained through sensing by a corresponding photosensitive unit when the display screen displays a black image. When the reference luminance value is the theoretical luminance value, as shown in FIG. 12, the pixel compensation device 500 further includes:

a first generation subcircuit 506, used to:

before the theoretical sensing data corresponding to the first target grayscale is determined from the compensation sensing model, sense the plurality of subpixels in each of the m target grayscales by using the plurality of photosensitive units, to obtain a theoretical luminance value of each subpixel in each target grayscale;

determine theoretical luminance values of the plurality of subpixels in each target grayscale as theoretical pixel data corresponding to each target grayscale;

determine theoretical sensing data corresponding to each target grayscale, where the theoretical sensing data includes the theoretical sensing parameter value of each photosensitive unit, and the theoretical sensing parameter value of each photosensitive unit is a sensing parameter value when each photosensitive unit senses the corresponding subpixel in each target grayscale; and generate the compensation sensing model based on theoretical pixel data corresponding to the m target grayscales and theoretical sensing data corresponding to the m target grayscales.

Figure 13:
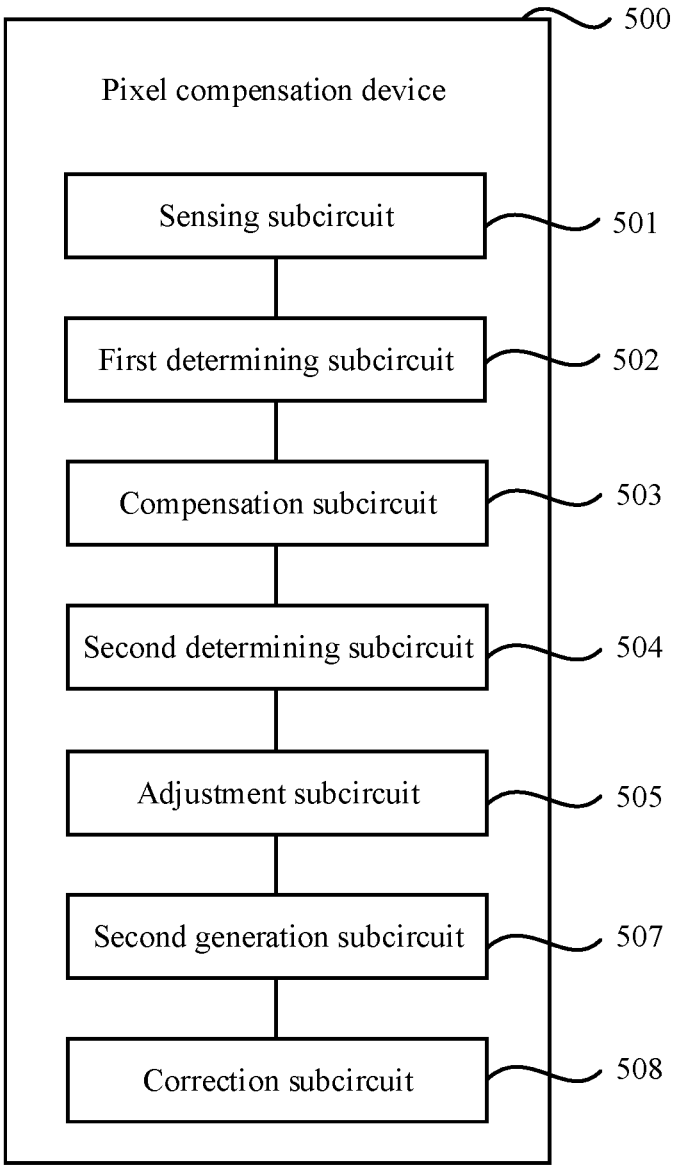
FIG. 13 is a block diagram of still another pixel compensation device according to an embodiment of the present disclosure.

When the reference luminance value is the difference between the theoretical luminance value and the initial luminance value, FIG. 13 is a block diagram of still another pixel compensation device according to an embodiment of the present disclosure. The pixel compensation device 500 further includes:

a second generation subcircuit 507, used to:

before the theoretical sensing data corresponding to the first target grayscale is determined from the compensation sensing model, sense the plurality of subpixels in each of the m target grayscales by using the plurality of photosensitive units, to obtain a theoretical luminance value of each subpixel in each target grayscale;

determine a difference between the theoretical luminance value of each subpixel and the initial luminance value of each subpixel in each target grayscale, to obtain a reference luminance value of each subpixel in each target grayscale;

determine reference luminance values of the plurality of subpixels in each target grayscale as theoretical pixel data corresponding to each target grayscale;

determine theoretical sensing data corresponding to each target grayscale, where the theoretical sensing data includes the theoretical sensing parameter value of each photosensitive unit, and the theoretical sensing parameter value of each photosensitive unit is a sensing parameter value when each photosensitive unit senses the corresponding subpixel in each target grayscale; and generate the compensation sensing model based on theoretical pixel data corresponding to the m target grayscales and theoretical sensing data corresponding to the m target grayscales.

Optionally, the first generation subcircuit 506 or the second generation subcircuit 507 is used to:

sense the plurality of subpixels in each of the m target grayscales by using the plurality of photosensitive units, to obtain a luminance value of each subpixel in each target grayscale;

determine whether the luminance value of each subpixel falls within a preset luminance value range; and if the luminance value of each subpixel falls within the preset luminance value range, determine the luminance value of each subpixel as a theoretical luminance value of each subpixel in each target grayscale; or if the luminance value of each subpixel falls outside the preset luminance value range, adjust a sensing parameter value of a photosensitive unit corresponding to each subpixel, so that a luminance value obtained when each photosensitive unit senses the corresponding subpixel based on an adjusted sensing parameter value falls within the preset luminance value range; and determine, as a theoretical luminance value of the subpixel in each target grayscale, a luminance value obtained when each photosensitive unit senses the corresponding subpixel based on an adjusted sensing parameter value.

The sensing parameter value of the photosensitive unit includes an illumination time and an integration capacitance, and optionally, the first generation subcircuit 506 or the second generation subcircuit 507 is used to: adjust at least one of the illumination time and the integration capacitance of the photosensitive unit corresponding to each subpixel based on a priority of the illumination time and a priority of the integration capacitance. For example, the priority of the illumination time may be higher than the priority of the integration capacitance.

Optionally, as shown in FIG. 12 or FIG. 13, the pixel compensation device 500 further includes:

a correction subcircuit 508, used to:

before whether the luminance value of each subpixel falls within the preset luminance value range is determined, and when the display screen displays a black image, sense the plurality of subpixels by using the plurality of photosensitive units, to obtain the initial luminance value of each subpixel;

determine a luminance correction value of each subpixel based on the initial luminance value of each subpixel; and correct the luminance value of each subpixel in each target grayscale based on the luminance correction value of each subpixel.

Optionally, the first generation subcircuit 506 or the second generation subcircuit 507 is used to: determine whether a corrected luminance value of each subpixel falls within the preset luminance value range.

Figure 14:
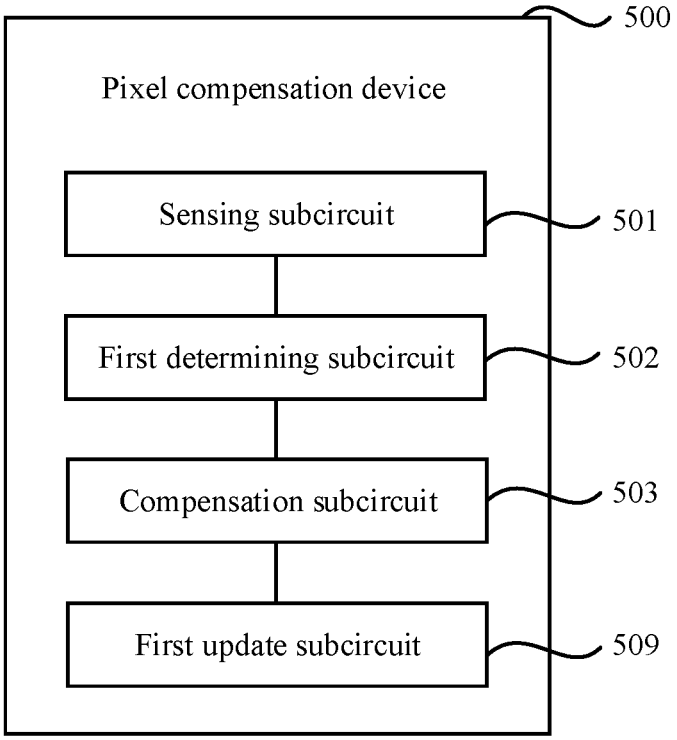
FIG. 14 is a block diagram of yet another pixel compensation device according to an embodiment of the present disclosure.

Optionally, when the reference luminance value is the theoretical luminance value, FIG. 14 is a block diagram of yet another pixel compensation device according to an embodiment of the present disclosure. The pixel compensation device 500 further includes:

a first update subcircuit 509, used to:

after the luminance of each subpixel is adjusted, determine an actual luminance value of each subpixel whose luminance is adjusted; and update the reference luminance value of each subpixel in the compensation sensing model using the actual luminance value of each subpixel.

Figure 15:
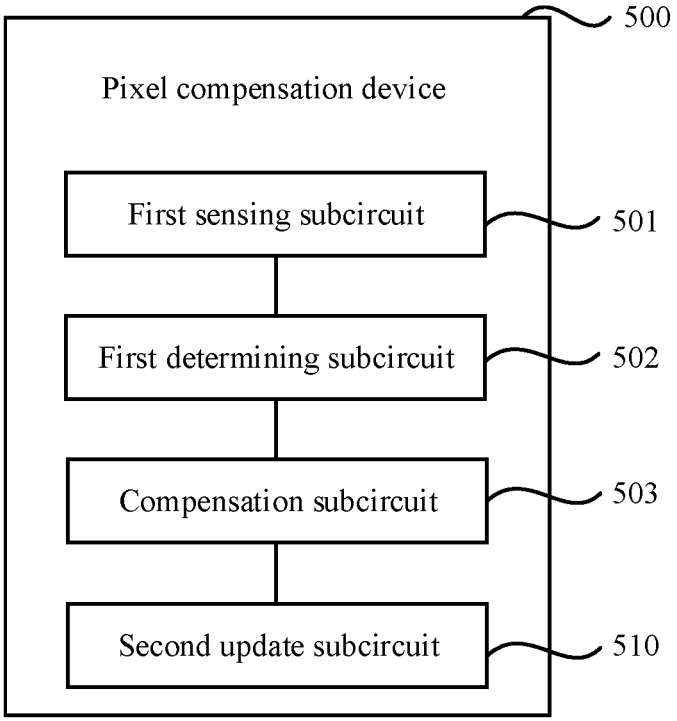
FIG. 15 is a block diagram of yet another pixel compensation device according to an embodiment of the present disclosure.

When the reference luminance value is the difference between the theoretical luminance value and the initial luminance value, FIG. 15 is a block diagram of yet another pixel compensation device according to an embodiment of the present disclosure. The pixel compensation device 500 further includes: a second update subcircuit 510, used to:

after the luminance of each subpixel is adjusted, and when the display screen displays a black image, sense the plurality of subpixels by using the plurality of photosensitive units, to obtain the initial luminance value of each subpixel;

determine an actual luminance value of each subpixel whose luminance is adjusted;

determine a difference between the actual luminance value of each subpixel and the initial luminance value of each subpixel; and update the reference luminance value of each subpixel in the compensation sensing model using the difference between the actual luminance value of each subpixel and the initial luminance value of each subpixel.

It should be noted that the sensing subcircuit 501 may be the sensing circuit shown in FIG. 2, and each of the first determining subcircuit 502, the compensation subcircuit 503, the second determining subcircuit 504, the adjustment subcircuit 505, the first generation subcircuit 506, the second generation subcircuit 507, the correction subcircuit 508, the first update subcircuit 509, and the second update subcircuit 510 may be a TCON processing circuit.

To sum up, the pixel compensation device provided in the embodiments of the present disclosure generates the compensation sensing model by using the first generation subcircuit or the second generation subcircuit, obtains the theoretical luminance value of the subpixel by using the first determining subcircuit and the second determining subcircuit. The display screen senses the subpixel by using the sensing subcircuit based on the theoretical sensing parameter value recorded in the compensation sensing model, to obtain the actual luminance value of the subpixel, and then compensates the subpixel by using the compensation subcircuit, thereby implementing pixel compensation during use of the display screen. In this way, compensation may be performed for an aging display screen, and uniformity of an image displayed by the display screen is enhanced. Further, in the process of generating the compensation sensing model by using the first generation subcircuit or the second generation subcircuit, the theoretical luminance value of the subpixel is corrected by using the initial luminance value of the subpixel obtained through sensing by using the correction subcircuit when the display screen displays the black image, so that accuracy of the compensation sensing model can be improved. In addition, after the subpixel is compensated, the reference luminance value of the subpixel in the compensation sensing model can be updated using the actual luminance value of the subpixel and by using the first update subcircuit or the second update subcircuit, to improve accuracy of subsequently compensating the subpixel.

Those skilled in the art may clearly learned that, for convenience and brevity of description, a detailed working process of the subcircuits of the above-described pixel compensation device can be referred to a corresponding process in the foregoing method embodiment, and is not described herein again in this embodiment of the present disclosure.

An embodiment of the present disclosure provides a storage medium. The storage medium stores an instruction, and when the instruction is run on a processing assembly, the processing assembly is enabled to perform the pixel compensation method according to the embodiment of the present disclosure.

An embodiment of the present disclosure provides a pixel compensation device, including:

a processor; and a memory for storing a processor executable instruction, where the processor is used to execute instruction stored in the memory, to perform the pixel compensation method according to the embodiment of the present disclosure.

An embodiment of the present disclosure provides a display screen. The display screen may include a plurality of subpixels and a plurality of photosensitive units in a one-to-one correspondence with the plurality of subpixels, and the pixel compensation device according to the foregoing embodiment. Each photosensitive unit is used to sense a corresponding subpixel. A location relationship between each photosensitive unit and the corresponding subpixel can be referred to FIG. 1, and is not described herein again.

To sum up, in the display screen provided in this embodiment of the present disclosure, the display screen may sense the subpixel by using the photosensitive unit, to obtain an actual luminance value of the subpixel, determine a theoretical luminance value of the subpixel based on a compensation sensing model, and then perform pixel compensation on the subpixel based on the theoretical luminance value and the actual luminance value of the subpixel, thereby implementing pixel compensation during use of the display screen. In this way, compensation may be performed for an aging display screen, and uniformity of an image displayed by the display screen is enhanced.

Other embodiments of the present disclosure will be apparent to those skilled in the art from consideration of the specification and practice of the present disclosure. This application is intended to cover any variations, uses, or adaptations of the present disclosure following the general principles thereof and including common knowledge or commonly used technical measures which are not disclosed herein. The specification and embodiments are to be considered as exemplary only, and the true scope and spirit of the present disclosure are indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure is only limited by the appended claims.

What is claimed is:

1. A pixel compensation method, applied to a display screen, wherein the display screen comprises a plurality of subpixels and a plurality of photosensitive units in a one-to-one correspondence with the plurality of subpixels, each photosensitive unit is used to sense a corresponding subpixel, and the method comprises:

sensing the plurality of subpixels in a first target grayscale of the display screen by using the plurality of photosensitive units, to obtain an actual luminance value of each subpixel;

determining a theoretical luminance value of each subpixel in the first target grayscale based on a compensation sensing model, wherein the compensation sensing model is used to record a correspondence between target grayscales and theoretical pixel data, the theoretical pixel data comprises a reference luminance value of each subpixel, and the theoretical luminance value of each subpixel is in a one-to-one correspondence with the reference luminance value of each subpixel; and performing pixel compensation on each subpixel based on the actual luminance value of each subpixel and the theoretical luminance value of each subpixel, wherein the compensation sensing model is used to record a one-to-one correspondence between every two of target grayscales, theoretical pixel data and theoretical sensing data, the theoretical sensing data comprises a theoretical sensing parameter value of each photosensitive unit, and the theoretical sensing parameter value of each photosensitive unit is a sensing parameter value when each photosensitive unit senses the corresponding subpixel and obtains a corresponding theoretical luminance value;

before the sensing the plurality of subpixels in a first target grayscale of the display screen by using the plurality of photosensitive units, to obtain an actual luminance value of each subpixel, the method further comprises:

determining theoretical sensing data corresponding to the first target grayscale from the compensation sensing model; and adjusting the sensing parameter value of each photosensitive unit based on the theoretical sensing data corresponding to the first target grayscale, so that the sensing parameter value of each photosensitive unit is the theoretical sensing parameter value, and the sensing the plurality of subpixels in a first target grayscale of the display screen by using the plurality of photosensitive units, to obtain an actual luminance value of each subpixel comprises:

sensing the plurality of subpixels in the first target grayscale based on corresponding theoretical sensing parameter values by using the plurality of photosensitive units, to obtain the actual luminance value of each subpixel.

2. The pixel compensation method according to claim 1, wherein the performing pixel compensation on each subpixel based on the actual luminance value of each subpixel and the theoretical luminance value of each subpixel comprises:

determining a compensation error of each subpixel based on the actual luminance value of each subpixel and the theoretical luminance value of each subpixel;

determining whether the compensation error of each subpixel falls within an error range; and if the compensation error of each subpixel falls outside the error range, adjusting luminance of each subpixel to perform pixel compensation on each subpixel.

3. The pixel compensation method according to claim 2, wherein the determining a compensation error of each subpixel based on the actual luminance value of each subpixel and the theoretical luminance value of each subpixel comprises:

determining the compensation error according to a compensation error formula, wherein the compensation error formula is as follows:

$$\Delta E = k \times x' - x, \text{ wherein}$$

66 E denotes the compensation error, x' denotes the actual luminance value, x denotes the theoretical luminance value, k is a compensation factor, and k is a constant greater than 0.

4. The pixel compensation method according to claim 2, wherein the reference luminance value is the theoretical luminance value, and after the adjusting luminance of each subpixel, the method further comprises:

determining an actual luminance value of each subpixel whose luminance is adjusted; and updating the reference luminance value of each subpixel in the compensation sensing model using the actual luminance value of each subpixel.

5. The pixel compensation method according to claim 2, wherein the reference luminance value is the difference between the theoretical luminance value and the initial luminance value, and after the adjusting luminance of each subpixel, the method further comprises:

when the display screen displays a black image, sensing the plurality of subpixels by using the plurality of photosensitive units, to obtain the initial luminance value of each subpixel;

determining an actual luminance value of each subpixel whose luminance is adjusted;

determining a difference between the actual luminance value of each subpixel and the initial luminance value of each subpixel; and updating the reference luminance value of each subpixel in the compensation sensing model to the difference between the actual luminance value of each subpixel and the initial luminance value of each subpixel.

6. The pixel compensation method according to claim 1, wherein the display screen has m target grayscales, the first target grayscale is any one of the m target grayscales, m is an integer greater than or equal to 1, and the reference luminance value is the theoretical luminance value; and before the determining theoretical sensing data corresponding to the first target grayscale from the compensation sensing model, the method further comprises:

sensing the plurality of subpixels in each of the m target grayscales by using the plurality of photosensitive units, to obtain a theoretical luminance value of each subpixel in each target grayscale;

determining theoretical luminance values of the plurality of subpixels in each target grayscale as theoretical pixel data corresponding to each target grayscale;

determining theoretical sensing data corresponding to each target grayscale; and generating the compensation sensing model based on theoretical pixel data corresponding to the m target grayscales and theoretical sensing data corresponding to the m target grayscales.

7. The pixel compensation method according to claim 6, wherein the sensing the plurality of subpixels in each of the m target grayscales by using the plurality of photosensitive units, to obtain a theoretical luminance value of each subpixel in each target grayscale comprises:

sensing the plurality of subpixels in each of the m target grayscales by using the plurality of photosensitive units, to obtain a luminance value of each subpixel in each target grayscale;

determining whether the luminance value of each subpixel falls within a luminance value range; and if the luminance value of each subpixel falls within the luminance value range, determining the luminance value of each subpixel as a theoretical luminance value of each subpixel in each target grayscale; or if the luminance value of each subpixel falls outside the luminance value range, adjusting a sensing parameter value of a photosensitive unit corresponding to each subpixel, so that a luminance value obtained when each photosensitive unit senses the corresponding subpixel based on an adjusted sensing parameter value falls within the luminance value range; and determining, as a theoretical luminance value of the subpixel in each target grayscale, the luminance value obtained when each photosensitive unit senses the corresponding subpixel based on the adjusted sensing parameter value.

8. The pixel compensation method according to claim 7, wherein the sensing parameter value of the photosensitive unit comprises an illumination time and an integration capacitance, and the adjusting a sensing parameter value of a photosensitive unit corresponding to each subpixel comprises: adjusting at least one of the illumination time and the integration capacitance of the photosensitive unit corresponding to each subpixel based on a priority of the illumination time and a priority of the integration capacitance, wherein the priority of the illumination time is higher than the priority of the integration capacitance.

9. The pixel compensation method according to claim 7, wherein before the determining whether the luminance value of each subpixel falls within a luminance value range, the method further comprises:

when the display screen displays a black image, sensing the plurality of subpixels by using the plurality of photosensitive units, to obtain the initial luminance value of each subpixel;

determining a luminance correction value of each subpixel based on the initial luminance value of each subpixel;

correcting the luminance value of each subpixel in each target grayscale based on the luminance correction value of each subpixel; and the determining whether the luminance value of each subpixel falls within a luminance value range comprises: determining whether a corrected luminance value of each subpixel falls within the luminance value range.

10. The pixel compensation method according to claim 1, wherein the display screen has m target grayscales, the first target grayscale is any one of the m target grayscales, m is an integer greater than or equal to 1, the reference luminance value is a difference between the theoretical luminance value and an initial luminance value, and the initial luminance value of each subpixel is a luminance value obtained through sensing by a corresponding photosensitive unit when the display screen displays a black image; and before the determining theoretical sensing data corresponding to the first target grayscale from the compensation sensing model, the method further comprises:

sensing the plurality of subpixels in each of the m target grayscales by using the plurality of photosensitive units, to obtain a theoretical luminance value of each subpixel in each target grayscale;

determining a difference between the theoretical luminance value of each subpixel and an initial luminance value of each subpixel in each target grayscale, to obtain a reference luminance value of each subpixel in each target grayscale;

determining reference luminance values of the plurality of subpixels in each target grayscale as theoretical pixel data corresponding to each target grayscale;

determining theoretical sensing data corresponding to each target grayscale; and generating the compensation sensing model based on theoretical pixel data corresponding to the m target grayscales and theoretical sensing data corresponding to the m target grayscales.

11. A non-transitory storage medium, wherein the non-transitory storage medium stores an instruction, and when the instruction is run on a processing assembly, the processing assembly is enabled to perform the pixel compensation method according to claim 1.

12. A pixel compensation device, comprising:

a processor; and a memory used to store an executable instruction of the processor, wherein the processor is used to execute the instruction stored in the memory, to perform the pixel compensation method according to claim 1.

13. A display screen, comprising: a plurality of subpixels, a plurality of photosensitive units in a one-to-one correspondence with the plurality of subpixels, and the pixel compensation device according to claim 12, and each photosensitive unit is used to sense a corresponding subpixel.

14. A pixel compensation device, applied to a display screen, wherein the display screen comprises a plurality of subpixels and a plurality of photosensitive units in a one-to-one correspondence with the plurality of subpixels, each photosensitive unit is used to sense a corresponding subpixel, and the device comprises:

a sensing subcircuit, used to sense the plurality of subpixels in a first target grayscale of the display screen by using the plurality of photosensitive units, to obtain an actual luminance value of each subpixel;

a first determining subcircuit, used to determine a theoretical luminance value of each subpixel in the first target grayscale based on a compensation sensing model, wherein the compensation sensing model is used to record a correspondence between target grayscales and theoretical pixel data, the theoretical pixel data comprises a reference luminance value of each subpixel, and the theoretical luminance value of each subpixel is in a one-to-one correspondence with the reference luminance value of each subpixel; and a compensation subcircuit, used to perform pixel compensation on each subpixel based on the actual luminance value of each subpixel and the theoretical luminance value of each subpixel, wherein the compensation sensing model is used to record a one-to-one correspondence between any two of target grayscales, theoretical pixel data, and theoretical sensing data, the theoretical sensing data comprises a theoretical sensing parameter value of each photosensitive unit, the theoretical sensing parameter value of each photosensitive unit is a sensing parameter value when each photosensitive unit senses the corresponding subpixel and obtains a corresponding theoretical luminance value, and the device further comprises:

a second determining subcircuit, used to determine theoretical sensing data corresponding to the first target grayscale from the compensation sensing model before the plurality of subpixels are sensed in the first target grayscale of the display screen by using the plurality of photosensitive units to obtain the actual luminance value of each subpixel; and an adjustment subcircuit, used to adjust the sensing parameter value of each photosensitive unit based on the theoretical sensing data corresponding to the first target grayscale, so that the sensing parameter value of each photosensitive unit is the theoretical sensing parameter value, wherein the sensing subcircuit is further used to sense the plurality of subpixels in the first target grayscale based on corresponding theoretical sensing parameter values by using the plurality of photosensitive units, to obtain the actual luminance value of each subpixel.

15. The pixel compensation device according to claim 14, wherein the compensation subcircuit is used to:

determine a compensation error of each subpixel based on the actual luminance value of each subpixel and the theoretical luminance value of each subpixel;

determine whether the compensation error of each subpixel falls within an error range; and if the compensation error of each subpixel falls outside the error range, adjust luminance of each subpixel to perform pixel compensation on each subpixel.

16. The pixel compensation device according to claim 15, wherein the compensation subcircuit is used to:

determine the compensation error according to a compensation error formula, wherein the compensation error formula is as follows:

$$\Delta E = k \times x' - x, \text{ wherein}$$

ΔE denotes the compensation error, x' denotes the actual luminance value, x denotes the theoretical luminance value, k is a compensation factor, and k is a constant greater than 0.

17. The pixel compensation device according to claim 14, wherein the display screen has m target grayscales, the first target grayscale is any one of the m target grayscales, m is an integer greater than or equal to 1, the reference luminance value is the theoretical luminance value, and the device further comprises:

a generation subcircuit, used to:

before the theoretical sensing data corresponding to the first target grayscale is determined from the compensation sensing model, sense the plurality of subpixels in each of the m target grayscales by using the plurality of photosensitive units, to obtain a theoretical luminance value of each subpixel in each target grayscale;

determine theoretical luminance values of the plurality of subpixels in each target grayscale as theoretical pixel data corresponding to each target grayscale;

determine theoretical sensing data corresponding to each target grayscale; and generate the compensation sensing model based on theoretical pixel data corresponding to the m target grayscales and theoretical sensing data corresponding to the m target grayscales.

18. The pixel compensation device according to claim 14, wherein the display screen has m target grayscales, the first target grayscale is any one of the m target grayscales, m is an integer greater than or equal to 1, the reference luminance value is a difference between the theoretical luminance value and an initial luminance value, the initial luminance value of each subpixel is a luminance value obtained through sensing by a corresponding photosensitive unit when the display screen displays a black image, and the device further comprises:

a generation subcircuit, used to:

before the theoretical sensing data corresponding to the first target grayscale is determined from the compensation sensing model, sense the plurality of subpixels in each of the m target grayscales by using the plurality of photosensitive units, to obtain a theoretical luminance value of each subpixel in each target grayscale;

determine a difference between the theoretical luminance value of each subpixel and an initial luminance value of each subpixel in each target grayscale, to obtain a reference luminance value of each subpixel in each target grayscale;

determine reference luminance values of the plurality of subpixels in each target grayscale as theoretical pixel data corresponding to each target grayscale;

determine theoretical sensing data corresponding to each target grayscale; and generate the compensation sensing model based on theoretical pixel data corresponding to the m target grayscales and theoretical sensing data corresponding to the m target grayscales.

* * * * *